US010137055B2

(12) United States Patent
Lawrie

(10) Patent No.: US 10,137,055 B2
(45) **Date of Patent: *Nov. 27, 2018**

(54) PORTABLE FITNESS ROLLER

(71) Applicant: Nathan Earl Lawrie, Santa Barbara, CA (US)

(72) Inventor: Nathan Earl Lawrie, Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/823,372

(22) Filed: Nov. 27, 2017

(65) Prior Publication Data

US 2018/0071166 A1 Mar. 15, 2018

Related U.S. Application Data

(63) Continuation of application No. 14/591,844, filed on Jan. 7, 2015, now Pat. No. 9,839,574.
(Continued)

(51) Int. Cl.
*A61H 15/00* (2006.01)
*A63B 21/00* (2006.01)

(52) U.S. Cl.
CPC ..... *A61H 15/0092* (2013.01); *A61H 15/00* (2013.01); *A61H 2015/0014* (2013.01);
(Continued)

(58) Field of Classification Search
CPC ..... A61H 15/00; A61H 15/0092; A61H 2015/0014; A61H 2201/0161;
(Continued)

(56) References Cited

U.S. PATENT DOCUMENTS 924,893 A * 6/1909 Doddridge ..... A47G 9/10 5/491
965,982 A * 8/1910 Beal et al. ..... F16L 9/003 138/158

(Continued)

FOREIGN PATENT DOCUMENTS

WO 2003006112 1/2003
WO 2004008421 1/2004

OTHER PUBLICATIONS

"Pilates Foam Roller Inflatable Exercise Roller," URL: http://healiohealth.com/products/index/1541, Heliohealth, copyright 2010.

*Primary Examiner* — Michael Tsai
*Assistant Examiner* — Christopher Miller
(74) *Attorney, Agent, or Firm* — Guy Cumberbatch

(57) ABSTRACT

A sturdy portable massage roller that collapses flat. The roller includes an outer contact skin formed of a plurality of longitudinal stiffeners connected by longitudinally-extending hinge points, the contact skin defining an inner cavity. A collapsible support structure within the contact skin inner cavity is sized to contact and radially support the longitudinal stiffeners in the expanded shape of the contact skin, and is adapted to collapse so that the massage roller converts between a generally cylindrical expanded shape and a collapsed, flattened shape. The support structure may include a series of rigid discs that either pivot or are folded in half to convert the massage roller between its expanded and flat configurations.

18 Claims, 22 Drawing Sheets

Related U.S. Application Data

(60) Provisional application No. 61/924,610, filed on Jan. 7, 2014.

(52) U.S. Cl.
CPC ..... *A61H 2015/0028* (2013.01); *A61H 2201/0161* (2013.01); *A61H 2201/1284* (2013.01); *A61H 2201/1695* (2013.01)

(58) Field of Classification Search
CPC .... A61H 2201/1683; A61H 2201/1685; A61H 7/003; A63B 2210/50; B65D 21/06; B65D 11/1873; B65D 37/00; B65D 57/00; B05C 17/02; A45D 34/04; A45D 34/041; Y10T 403/12; Y10T 403/125; Y10T 403/16
USPC ..... 220/4.08, 4.28, 6, 9.1, 9.2, 9.3, 9.4
See application file for complete search history.

(56) References Cited

U.S. PATENT DOCUMENTS 1,274,595 A * 8/1918 Ranz ..... A47G 9/10 5/636
1,395,506 A 11/1921 Forsman
1,561,203 A 11/1925 Anderson
2,226,178 A * 12/1940 Page ..... B65D 3/10 229/117.01
2,461,413 A * 2/1949 Dirand ..... A61H 15/0092 601/120
2,593,056 A 4/1952 Sage
2,747,210 A 5/1956 Canning
2,883,681 A 4/1959 Caplan
2,970,366 A 2/1961 Gill
3,628,790 A * 12/1971 Gordon ..... A63B 6/00 273/DIG. 6
3,713,455 A * 1/1973 Chen ..... A45D 2/24 132/262
4,081,870 A 4/1978 Iannucci
4,141,370 A * 2/1979 Haas ..... A45D 2/148 132/245
4,141,371 A * 2/1979 Gangnath ..... A45D 2/148 132/245
4,209,883 A * 7/1980 Hawk ..... B05C 17/02 15/230.11
4,274,170 A * 6/1981 Simpson ..... B63B 7/06 114/347
4,651,791 A * 3/1987 Evenson ..... B65D 11/1873 220/625
4,756,035 A * 7/1988 Beier ..... A47G 9/1081 5/640
4,841,899 A * 6/1989 Fleckles ..... B63B 7/06 114/347
5,150,897 A * 9/1992 Wortman ..... A63B 59/50 473/567
5,225,254 A * 7/1993 Foulke ..... E01F 9/654 116/63 C
5,327,765 A 7/1994 Weykamp
5,352,187 A 10/1994 Tseng
5,360,111 A 11/1994 Arispe
5,572,757 A * 11/1996 O'Sullivan ..... A47C 7/46 297/284.5
5,802,644 A 9/1998 Scheurer
5,904,406 A 5/1999 Stewart
6,101,662 A 8/2000 Polzin
6,564,960 B1 * 5/2003 Grindstaff ..... A01G 9/026 217/12 R
6,763,538 B1 * 7/2004 Tsai ..... A47G 9/1009 5/636
7,112,178 B1 9/2006 Roozenberg
7,137,926 B2 11/2006 Barrows
7,347,493 B2 * 3/2008 Mulmed ..... A47B 87/007 297/233
8,556,837 B1 * 10/2013 Poirier ..... A61H 15/00 601/46
8,821,352 B2 9/2014 Crowell
10,040,598 B2 * 8/2018 Woodlock ..... A47J 47/02
2003/0010744 A1 1/2003 Ma
2003/0126684 A1 * 7/2003 Han ..... A47C 20/023 5/630
2004/0254507 A1 12/2004 Off
2005/0145192 A1 * 7/2005 Axelrod ..... A01K 1/0245 119/499
2006/0142677 A1 6/2006 Perez
2006/0241537 A1 10/2006 Liu
2008/0018167 A1 * 1/2008 Fuji ..... A61H 15/0092 301/5.23
2008/0200851 A1 8/2008 Faussett
2009/0176635 A1 7/2009 Brinson
2009/0199468 A1 * 8/2009 Gioia ..... A47F 7/0078 47/41.01
2009/0306560 A1 12/2009 Lund
2010/0043147 A1 * 2/2010 Popp ..... A47D 13/083 5/636
2010/0218719 A1 9/2010 Belley
2011/0152035 A1 6/2011 Wahl
2011/0225735 A1 * 9/2011 Heroux ..... A47G 9/10 5/640
2011/0257569 A1 10/2011 Robins
2012/0035029 A1 2/2012 Dye
2012/0065557 A1 3/2012 Phillips
2012/0084924 A1 * 4/2012 Cheng ..... A47G 9/10 5/655.9
2012/0122635 A1 5/2012 Tsai
2012/0322633 A1 12/2012 Holman
2013/0096472 A1 4/2013 Bertram
2013/0138024 A1 * 5/2013 Jennings ..... A61H 15/0092 601/119
2013/0178766 A1 7/2013 Abdur-Raoof
2013/0178768 A1 7/2013 Dalebout
2014/0128786 A1 5/2014 Ross
2015/0150391 A1 6/2015 Hsu

* cited by examiner

Fig. 10C
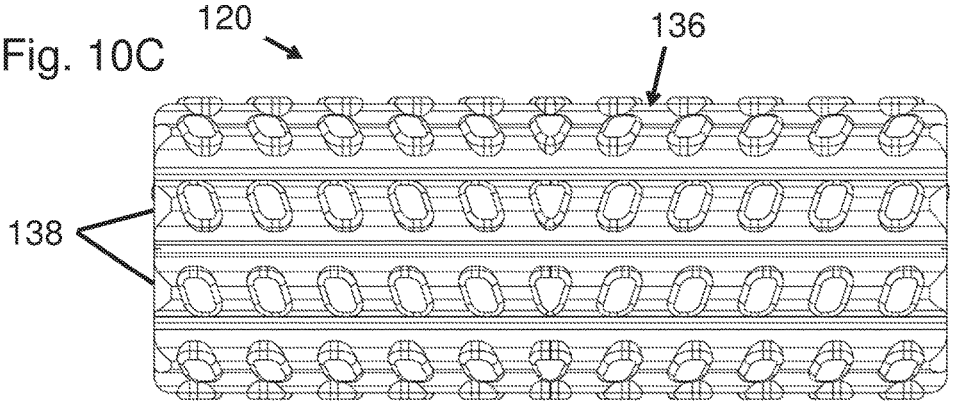
Fig. 10D
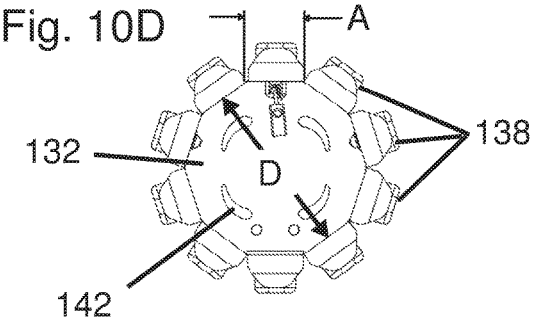
Fig. 10E
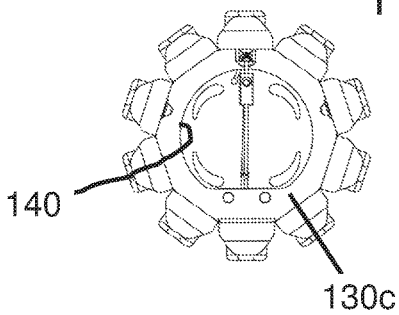
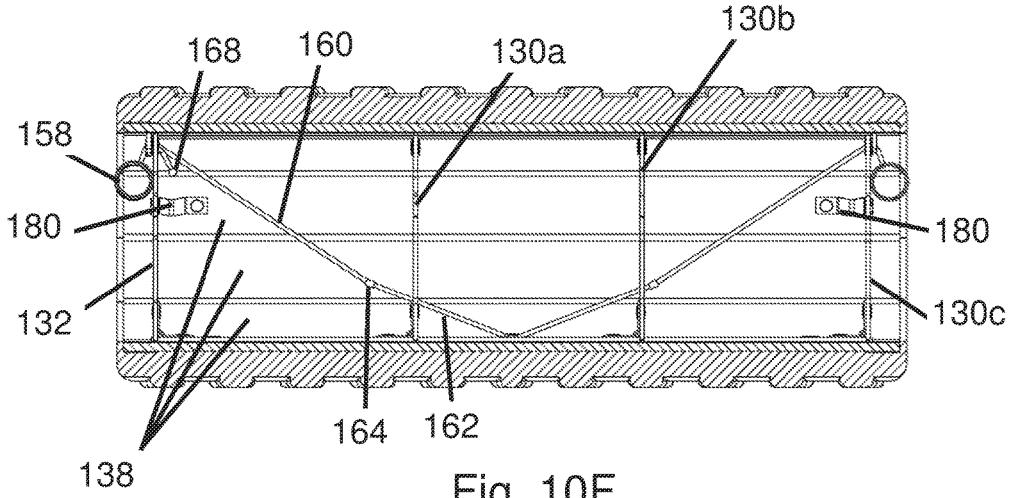
Fig. 10F

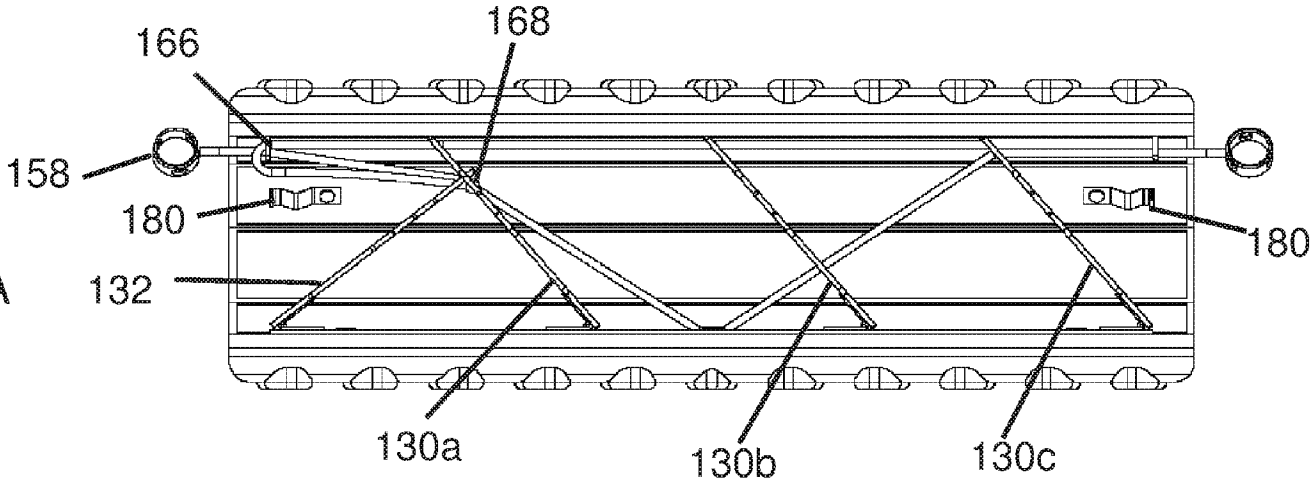
Fig. 11A
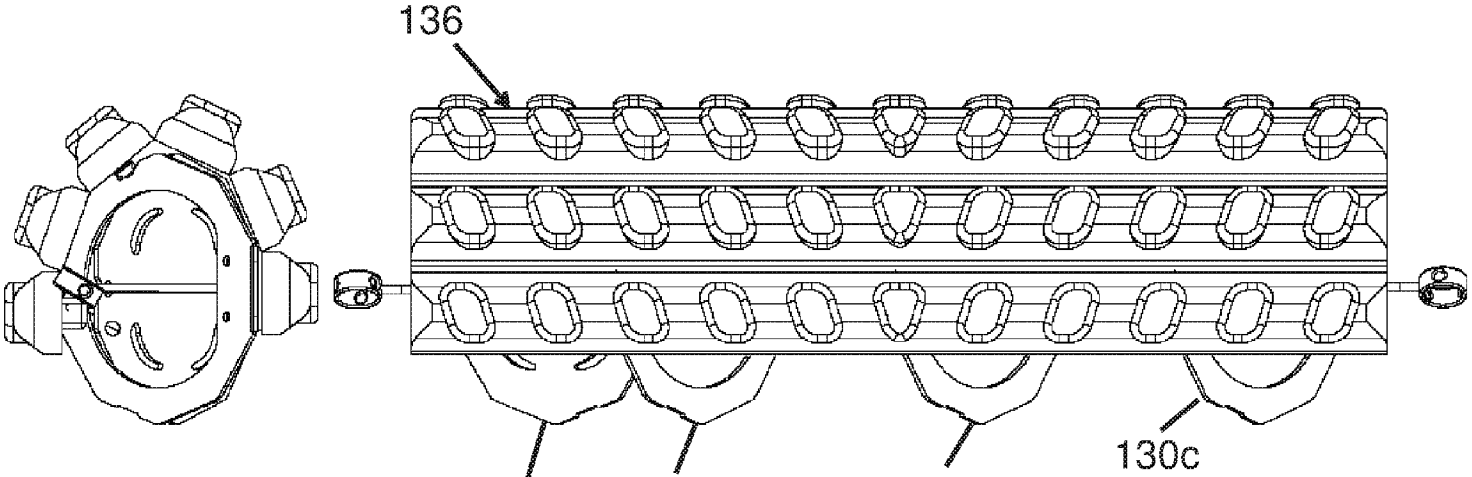
Fig. 11C
Fig. 11B

PORTABLE FITNESS ROLLER

RELATED APPLICATIONS

The present application is a continuation of U.S. application Ser. No. 14/591,844, filed Jan. 7, 2015, which claims priority under 35 U.S.C. § 119 to U.S. Provisional Application No. 61/924,610, filed Jan. 7, 2014.

FIELD OF THE INVENTION

The present invention relates to a portable massage roller and, more particularly, to a sturdy massage roller that collapses flat.

BACKGROUND OF THE INVENTION

Over the last decade, athletes have adopted the foam roller as a vital tool of their pre-habilitation, rehabilitation, and core training processes. As a post workout self-massage device, the foam roller helps to breakdown adhesions in muscles and provide for quicker recovery. As a core-training device, the foam roller provides an unstable platform that allows an athlete to train stabilizing muscles that are hard to isolate with traditional core exercises. It's an invaluable tool to anyone that takes training seriously. The foam roller has one flaw. It is hard to transport. While lightweight, foam rollers are bulky. This is a nuisance for anyone with limited space at home or who would like to take their foam roller on the road (either to the gym, Pilates studio, business trip, back-country, or triathlon).

Vigorous stretching for athletes is very beneficial and cannot be neglected. In the case of muscle knots however, stretching alone is not always enough. An effective way of attacking a troublesome muscle knot is by the application of direct pressure. The art of massage has long been used to relieve various muscle, tendon and other connective tissue ailments. The kneading of muscles, for example, imparts a modification to the muscle tissue that acts beneficially on the nerves, the muscles being controlled by the nerves in both their movement and nourishment, health of the muscle tissue due to improved blood circulation, and effusion of waste material from the muscle and connective tissues. Accordingly, numerous self-actuated devices are known in the art for massaging muscles or other tissues. A highly-effective, yet economical device to eliminate and prevent muscle knots and treat other tissue ailments in the back and limbs is a foam roller. A foam roller is a firm foam cylinder usually having a diameter of about 6 inches. In use, the user lies on the foam roller to allow his or her own body weight to apply pressure to the muscles that are directly on top of the roller. By rolling back and forth on the roller, the user effectively kneads the muscle. A full array of movements can be performed, but most typically this device is used on back, leg, arm, and neck muscles. The idea is similar to using a rolling pin to roll out lumps in bread dough. A foam roller is a good alternative to repetitive trips to the massage therapist and is a highly-effective way to treat and prevent the most common injuries seen in all athletes. Additionally, the roller can be used as a spinal self-adjusting device. By rolling with the roller perpendicular to the spine, a user can adjust each vertebra individually and prevent the need for repetitive trips to the chiropractor. More so, many core strengthening exercises have been developed to use the rollers shape to help isolate hard to train stabilizing muscles.

Foam rollers are generally lightweight. However, athletes, sports teams or others with mobile massage therapy needs often fly to their destinations, making even a single foam roller, let alone enough for a team, a bulky addition. Therefore, there remains a need for a massage roller that can assume a smaller profile.

SUMMARY OF THE INVENTION

The present application provides a portable massage roller that collapses flat and can easily be deployed for use by a full size adult. The roller includes an outer contact skin formed of a plurality of longitudinal stiffeners connected by longitudinally-extending hinge points, the contact skin defining an inner cavity. A collapsible support structure within the contact skin inner cavity is sized to contact and radially support the longitudinal stiffeners in the expanded shape of the contact skin, and is adapted to collapse so that the massage roller converts between a generally cylindrical expanded shape and a collapsed, flattened shape. The support structure may include a series of rigid discs that either pivot or are folded in half to convert the massage roller between its expanded and flat configurations.

In one aspect, the application discloses a portable massage roller comprising an outer contact skin having an outer surface suitable for use as a portable massage roller, the outer contact skin defining an inner cavity. The contact skin adapted to convert between a generally tubular expanded configuration and a collapsed configuration in which a volume of the roller is substantially reduced. A collapsible support structure is disposed within the contact skin inner cavity and is sized to contact and radially support the contact skin in its expanded configuration. The collapsible support structure is further adapted to convert the contact skin between its expanded and collapsed configurations. The collapsible support structure may comprise a plurality of rigid discs each adapted to pivot from an orientation generally perpendicular to the longitudinal axis in the expanded configuration of the roller to an orientation generally parallel to the longitudinal axis in the collapsed configuration of the roller. Each of the rigid discs preferably may have a circular or polygonal exterior contour. In one embodiment, a first one of the rigid discs is located at one end of the collapsible support structure and pivots inward toward the other rigid discs, while the other rigid discs all pivot toward the first rigid disc. In another embodiment, a first pair of rigid discs pivots inward toward a second pair of rigid discs, and the second pair of rigid discs pivots toward the first pair of rigid discs. The collapsible support structure may include a rigging system with pull rings on both ends of the roller which when pulled convert the roller from its collapsed to its expanded configuration. The collapsible support structure may have at least one inner disc at one end of the roller providing radial support to the outer contact skin and pushing the inner disc inward converts the roller from its expanded to its collapsed configuration. The outer contact skin preferably includes a series of axial stiffeners parallel to a longitudinal axis and extending a length of the contact skin.

In another aspect, a portable massage roller comprises an outer contact skin having a series of longitudinal stiffeners parallel to a longitudinal axis, the contact skin having an inner cavity. A plurality of stiffening discs disposed within the contact skin inner cavity are sized to contact and radially support the longitudinal stiffeners in a first orientation to provide inner support for an expanded shape of the contact skin, and each stiffening disc is adapted to be displaced from the first orientation relative to the longitudinal stiffeners to a second orientation to permit collapse of the outer profile of the contact skin. The massage roller is configured to convert between a generally cylindrical expanded shape adapted to support the weight of a person rolling on the roller and a collapsed, flattened shape. The stiffening discs may each be adapted to pivot from their first orientation generally perpendicular to the longitudinal stiffeners to their second orientation generally parallel to the longitudinal stiffeners. Desirably, the stiffening discs are all mounted to pivot on a longitudinal spar attached to an inner side of the outer contact skin. Alternatively, the stiffening discs are each adapted to fold from their first orientation generally planar and perpendicular to the longitudinal stiffeners to their second orientation generally folded in half and parallel to the longitudinal stiffeners. The stiffening discs each may have a polygonal or circular exterior contour and includes cutouts to reduce their weight. The outer contact skin preferably includes the longitudinal stiffeners inserted into longitudinal cavities formed in a foam connecting sheet with longitudinally-extending living hinges in between the longitudinal stiffeners. The collapsible support structure may feature a rigging system with cords connected between the stiffening discs to coordinate their conversion between the first and second orientations.

In a still further embodiment, a portable massage roller comprises an outer contact skin with an outer surface suitable for use as a portable massage roller, the contact skin having a series of longitudinally-extending ribs connected by longitudinally-extending hinge points. The contact skin is configured to convert between a generally tubular expanded shape having an inner cavity circular or polygonal in cross-section and a generally elliptical collapsed shape with the inner cavity conforming to the collapsed shape, wherein the ribs remain parallel to a central axis of the tube when expanded and parallel to two focal points of the elliptical shape when collapsed. A collapsible support structure disposed within the contact skin inner cavity is sized to contact and radially support the longitudinally-extending ribs to provide inner support for the expanded shape of the contact skin, and the collapsible support structure is adapted to collapse and permit the outer contact skin to assume its collapsed shape. The collapsible support structure preferably includes a plurality of stiffening discs disposed within the contact skin inner cavity sized to contact and radially support the ribs in the expanded shape of the contact skin, each stiffening disc being hinged relative to a fixed point within the inner cavity and adapted to pivot from a generally perpendicular orientation relative to the ribs to an orientation generally parallel to the ribs, at least two of the discs being coupled to pivot together. The collapsible support structure preferably includes a rigging system with cords connected between the stiffening discs to coordinate their conversion between the first and second orientations. The rigging system may have pull rings on both ends of the roller which when pulled convert the roller from its collapsed to its expanded configuration. The outer contact skin desirably includes the longitudinal ribs inserted into longitudinal cavities formed in a foam connecting sheet with longitudinally-extending living hinges in between the longitudinal stiffeners. Further, the foam connecting sheet features a series of bumps arrayed longitudinally outward of each longitudinal cavity.

BRIEF DESCRIPTION OF THE DRAWINGS

Features and advantages of the present invention will become appreciated as the same become better understood with reference to the specification, claims, and appended drawings wherein:

FIGS. 10C-10F are side, end elevational, and longitudinal sectional views of the portable massage roller in its expanded configuration;

FIGS. 11A-11F show the portable massage roller in a partially collapsed configuration;

DETAILED DESCRIPTION OF THE PREFERRED EMBODIMENTS

The present invention pertains to a collapsible massage roller or back roller. The roller can be soft on the outside or relatively firm. The roller preferably converts between a cylinder that is used as a massager, and a flattened shape for storage or transport. The roller can easily be collapsed in a matter of seconds, but is extremely strong and can support the weight of grown men. Various expanded shapes that can roll other than pure cylinders are contemplated, including slightly elliptical as well as polygonal. Indeed, as will be seen, two different exemplary embodiments include ten and fourteen distinct longitudinal spaced stiffening bars on the exterior of the roller, forming essentially a decagon and a so-called Tetradecagon. A plurality of stiffening bars could be used to achieve this function and are contemplated. Consequently, the term, generally cylindrical (or generally tubular) encompasses many forms that are capable of rolling under someone's back so as to perform as a massage roller.

Figure 1A:
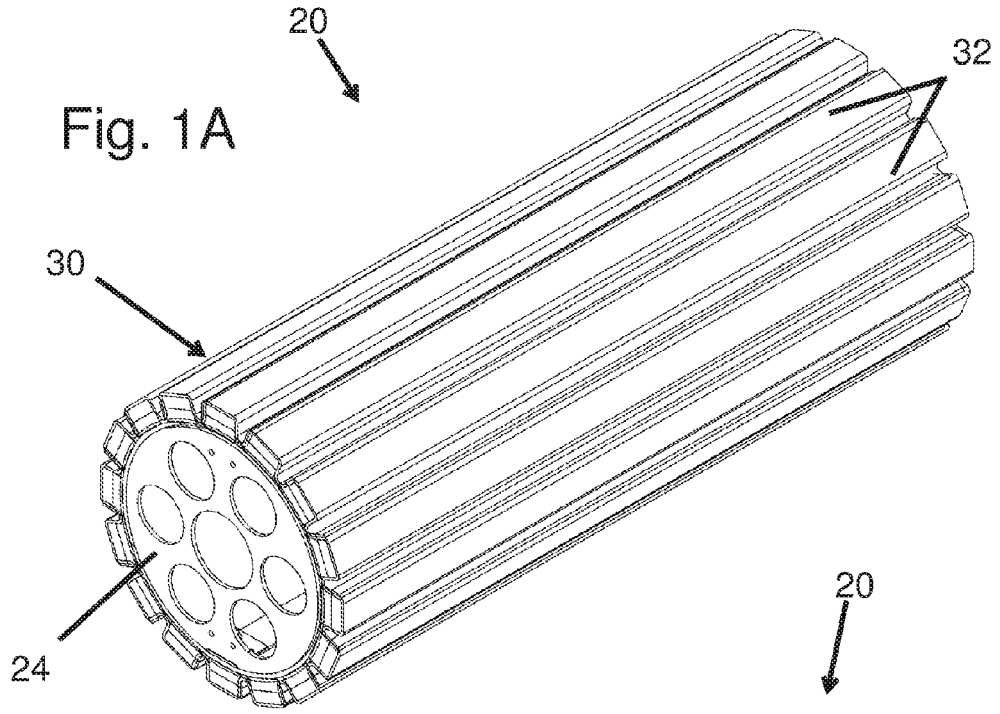
FIG. 1A is a perspective view of an exemplary portable massage roller.
Figure 1B:
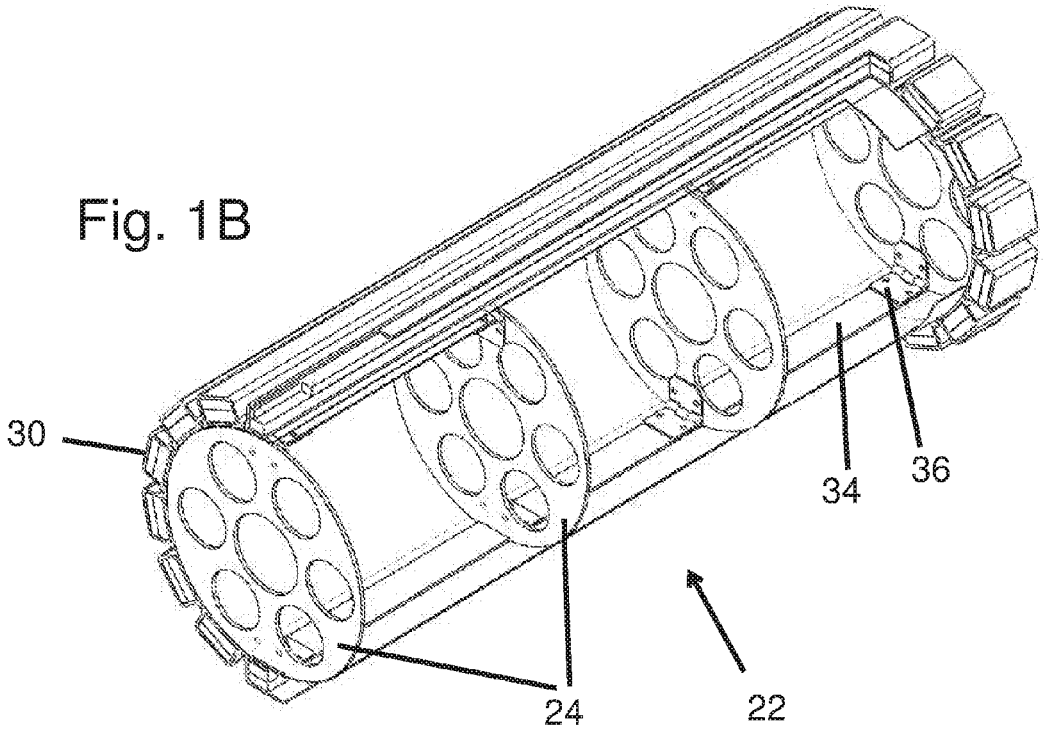
FIG. 1B is a cutaway view of the massage roller exposing internal stiffening discs and ribs.

FIG. 1A illustrates an exemplary portable massage roller 20 in an expanded configuration, while in FIG. 1B a portion of the roller is cut away to expose an inner cavity within which is mounted an internal collapsible support structure 22 comprising stiffening discs 24. The massage roller 20 has two main components, an outer contact skin 30 and the internal collapsible support structure 22. The outer contact skin 30 is desirably padded or otherwise made soft to provide a surface suitable for foam rolling. In the expanded configuration, the massage roller 20 has a generally cylindrical shape with a length and diameter that may vary greatly. In an exemplary embodiment, the diameter of the massage roller 20 is between 5-7 inches (~13-18 cm), and has a length of between 14-36 inches (~35-91 cm). Preferably, the massage roller 20 is made of lightweight materials, such that the smallest roller desirably weighs less than about 2 pounds, while the largest embodiment weighs no more than 4 pounds.

Figure 2A:
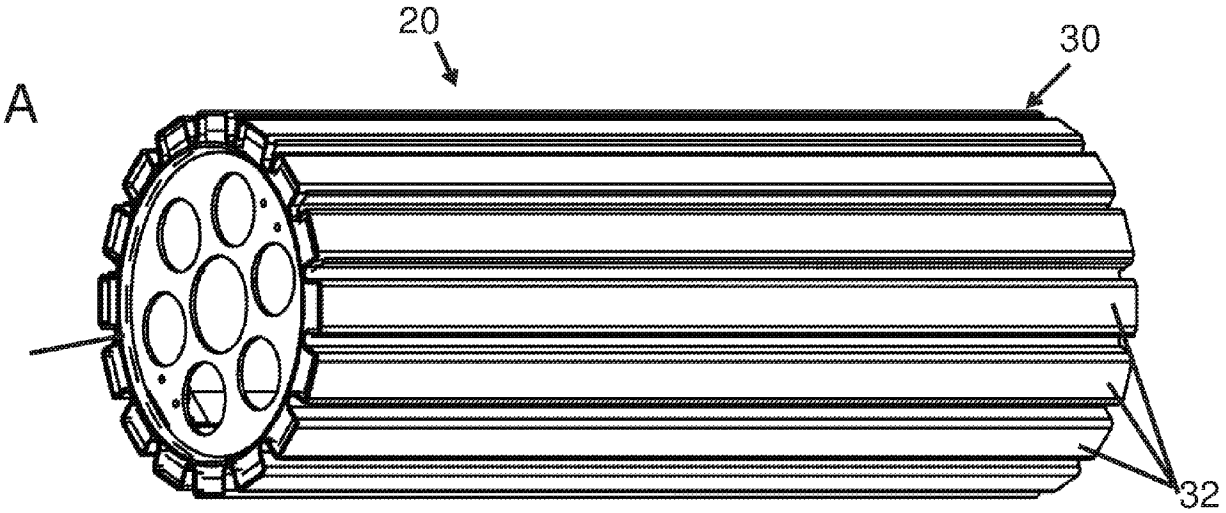
FIGS. 2A-2C are perspective, and side and end elevational views of the portable massage roller in its expanded configuration.
Figure 2B:
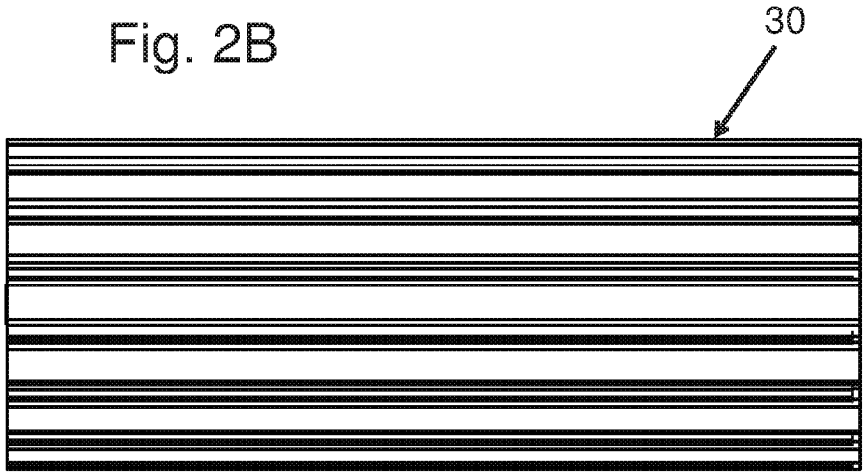
Figure 2C:
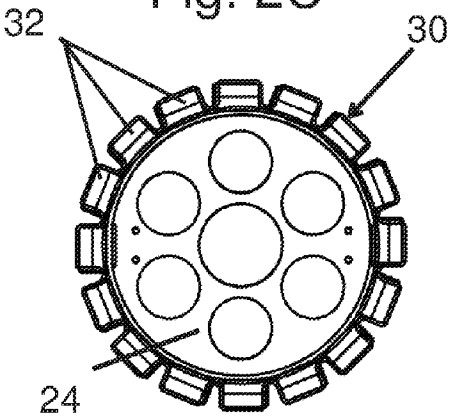

With reference also to FIGS. 2A-2C, the outer skin 30 of the massage roller 20 desirably comprises a plurality of axially-oriented bars (longitudinal stiffeners) 32 that extend the full length of the roller. As will be explained, the bars 32 are supported by internal stiffening discs 24 spaced within the roller such that the entire assembly is sufficiently strong enough to withstand the force transmitted through the longitudinal stiffeners to the inner support structure from someone lying, kneeling, or standing on the roller 20. In the illustrated embodiment, there are four stiffening discs 24, with one at each end thereof and two intermediate and preferably spaced evenly apart therebetween.

The stiffening discs 24 are shown circular having a plurality of large holes therein to reduce their weight. It should be noted that the cutouts are not necessary to the operation of the collapsible foam roller, though they provide openings for passage of deployment cords, as will be shown. The stiffening discs 24 have a nominal radius R of varying magnitudes, preferably between 4-10 cm. In the exemplary embodiment, the radius R is about 5.8 cm and the overall diameter of the back roller is about 14.5 mm (5.7 inches). Of course, the number and configuration of stiffening discs 24 may vary depending on the length of the roller 20 and the particular construction of the collapsible support structure 22. Alternative configurations are described below.

Figure 3A:
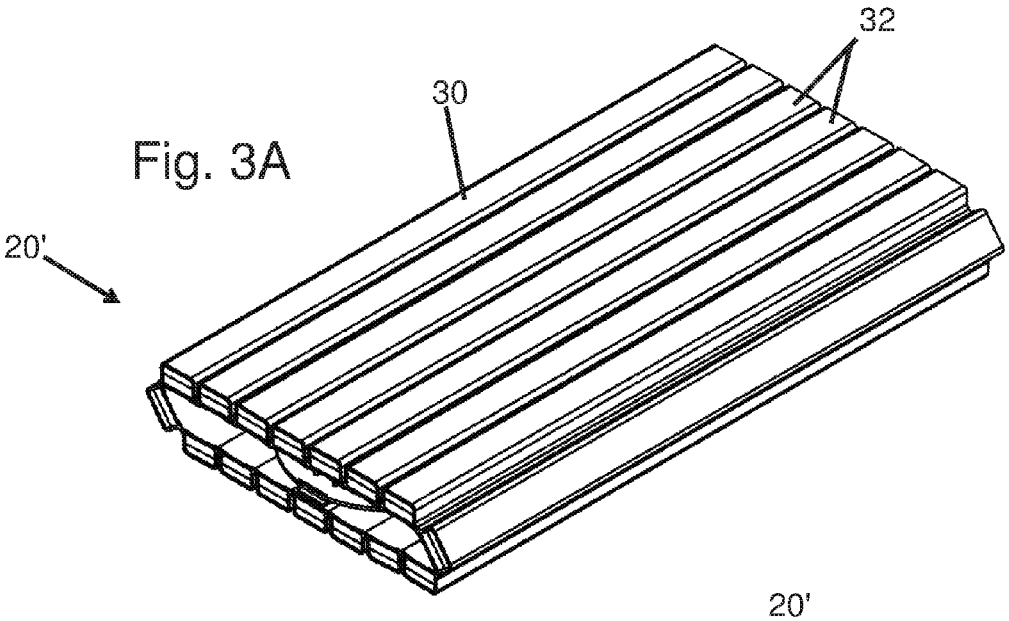
FIGS. 3A-3C are perspective, and side and end elevational views of the portable massage roller in its collapsed, flattened configuration.
Figure 3B:
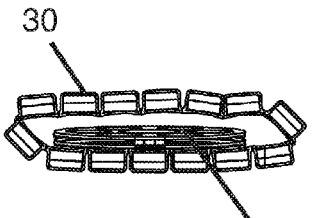
Figure 3C:
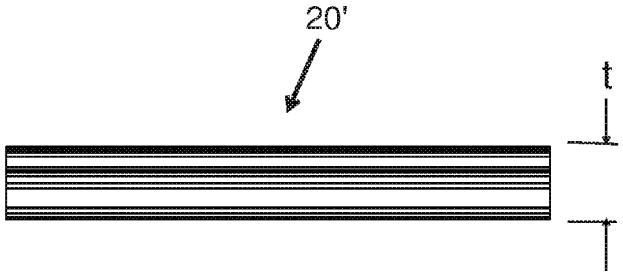
Figure 4:
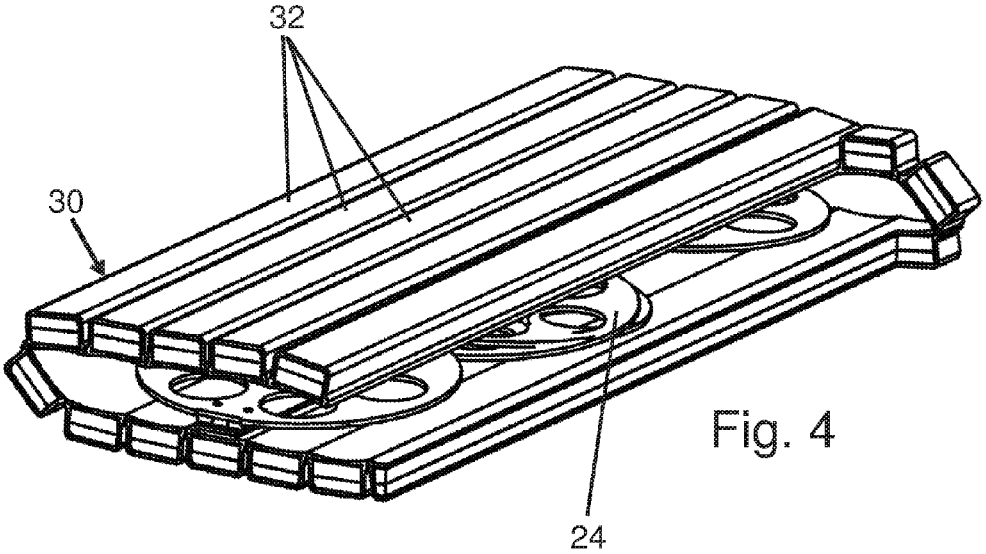
FIG. 4 is a perspective view of the portable massage roller in its collapsed configuration partially cutaway to show the collapsed internal stiffening discs and ribs.

Now with reference to FIGS. 3A-3C, the portable massage roller 20 is shown in its collapsed, substantially flattened configuration. FIG. 4 shows how the collapsed internal stiffening discs 24 lie flat within the inner cavity of the contact skin 30. While in the expanded configuration the outer contact skin 30 is substantially tubular. When collapsed, the outer skin flattens into approximately an elliptical or rectangular shape. Of course, because of the presence of the internal collapsible structure 22, and the discontinuous outer surface formed by the longitudinal bars 32, the shape of the contact skin 30 is not precisely elliptical. The ability to flatten the massage roller 20 greatly reduces its total volume, and permits it to be easily stored in a closet or packed in a suitcase or other such travel container without taking up too much room. In one example, the total thickness t of the massage roller 20 in its collapsed configuration, as shown in FIG. 3C, is no more than twice the thickness of the contact skin 30 plus the thickness of the collapsed support structure 22. For example, the total thickness t is desirably less than about 2 inches (~5-8 cm).

Figure 5A:
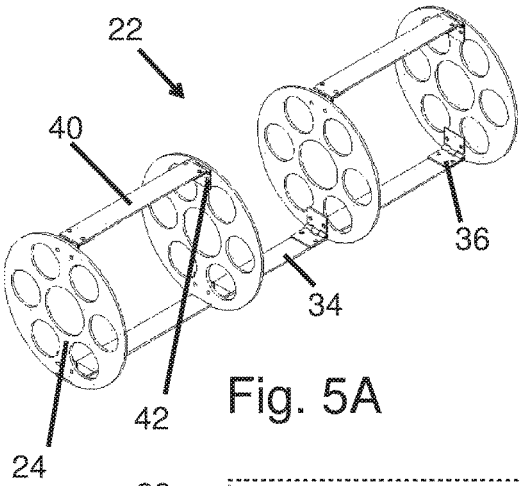
FIG. 5A is a perspective view of an exemplary assembly of internal stiffening discs and ribs in their expanded configuration.
Figure 5B:
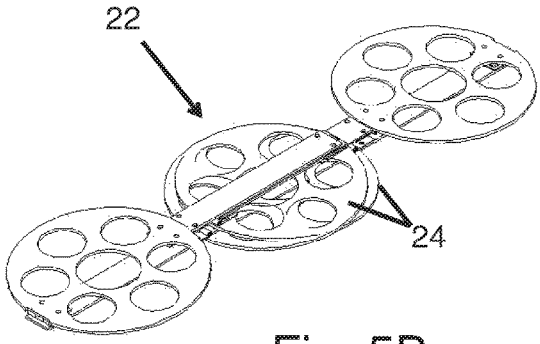
FIG. 5B is a perspective view of the assembly fully collapsed.

With particular reference to FIGS. 1B and 5A-5B, the exemplary assembly of internal stiffening discs 24 will be described. This embodiment could be used with the outer contact skin 30, or with any contact skin disclosed herein. As mentioned, there are preferably four stiffening discs 24 arrayed evenly along the length of the massage roller 20, although this number and spacing may vary. The stiffening discs 24 are connected to each other via a common longitudinal spar 34 that also extends substantially the length of the massage roller. Each of the discs 24 connects to the spar 34 by a hinge 36 or pivot point. The longitudinal spar 34 is in turn secured to an inner surface of the contact skin 30 by various means, including adhesive, fasteners, rivets, etc. In this way, each of the stiffening discs 24 is hinged relative to a fixed point within the inner cavity of the contact skin 30. In this embodiment two of the discs 24 are hinge to pivot in one direction and the other two in the opposite direction. Though the exemplary assembly shows the support discs connected along the common spar and hinged accordingly, it is not necessary for the support discs to be connected or hinged and could alternatively be independent of each other. For example, the independent support discs could be inserted individually into the contact skin and fastened into place by various methods in order to support the expanded foam roller.

Desirably, each of the stiffening discs 24 is also coupled to one of the other discs at locations diametrically opposite to the spar 34. For example, the first two discs 24 on the left in FIG. 5A are coupled to each other via a subspar 40 and a pair of connectors or hinges 42. Likewise, the two discs 24 on the right are also coupled via a subspar 40 and a pair of hinges 42. The discs 24 and the subspars 40 remain disconnected from the inner wall of the contact skin 30. In this way, the two pairs of discs 24 can each pivot together within the roller inner cavity about the fixed spar 34 via the hinges 36, because they are connected by the subspar 40 and hinges 42. The final collapsed configuration of the internal support structure 22 is shown in FIG. 5B, wherein two of the discs 24 lie on top of one another in the middle of the structure. Alternatively, the discs 24 could collapse to form a sandwich of 3 and 1, or a different combination depending on number of support discs.

Figure 6A:
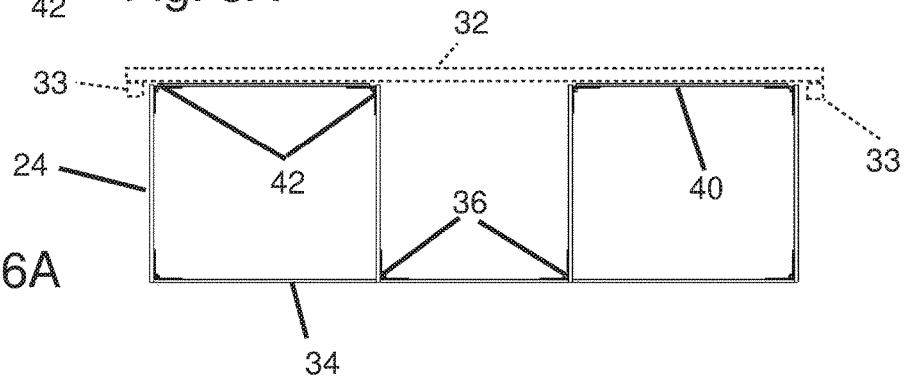
FIGS. 6A-6C are elevational views of the internal stiffening discs and ribs shown in a sequence from their expanded configuration to their collapsed configuration.
Figure 6B:
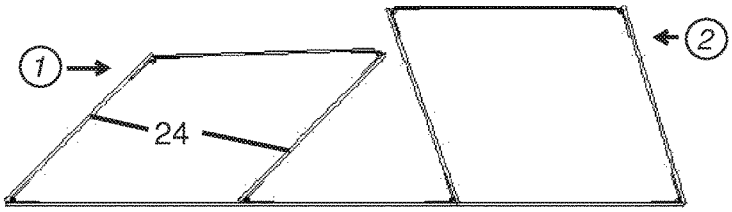
Figure 6C:
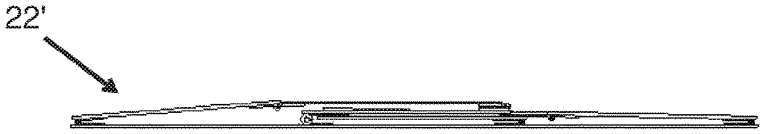

FIGS. 6A-6C illustrate a preferred sequence when the internal collapsible support structure 22 converts from its expanded configuration to its collapsed configuration. The expanded configuration in FIG. 6A shows the discs 24 substantially perpendicular to the fixed spar 34 and the movable subspars 40. In this configuration, the discs 24 are oriented to contact and radially support the longitudinal stiffeners within the contact skin 30. It should be understood, however, that the discs 24 may be configured to provide the radial support when not completely perpendicular, such as 80°-100° relative to the longitudinal axis of the roller 20. When the user wishes to collapse the massage roller 20, he or she pushes the left or right connected pairs of discs 24 inward from the open end of the roller. For example, in FIG. 6B the leftmost disc 24 is first pushed inward (to the right) so that it pivots about its hinge 36. By virtue of the connecting subspar 40, this action also pivots the second disc 24 to the right. Desirably the two leftmost discs 24 are first pushed to begin the collapsing process and subsequently, the user pushes inward on the rightmost disc 24, causing it and the next disc to the left to pivot inward (to the left). The roll collapses until finally, the connected assembly of the second pair of discs 24 lies on top of the first pair and the entire roll assumes its flattened position. FIG. 6C shows the two left discs 24 lying on top of the two right discs, which also illustrates the ambidextrous nature of the collapsible structure 22'.

Several methods have been considered for locking the expanded support structure in the open position. The current configuration provides a series of hemispherical stoppers secured inside the contact skin that stop the stiffening discs at slightly past the perpendicular position. For example, FIG. 6A schematically illustrates in phantom an exemplary longitudinal stiffener 32 having two stoppers 33 secured on an inside surface which two of the collapsible discs 24 can contact, such as just past 90°. By allowing the discs to open at slightly past 90 degrees, the user's weight will effectively and continuously push the discs towards the open position and thereby hold the support structure open. Methods to snap the support disc into a pressure fitted locking channel also secured to the inside of the longitudinal stiffeners 32 and other means are also considered.

Figure 7A:
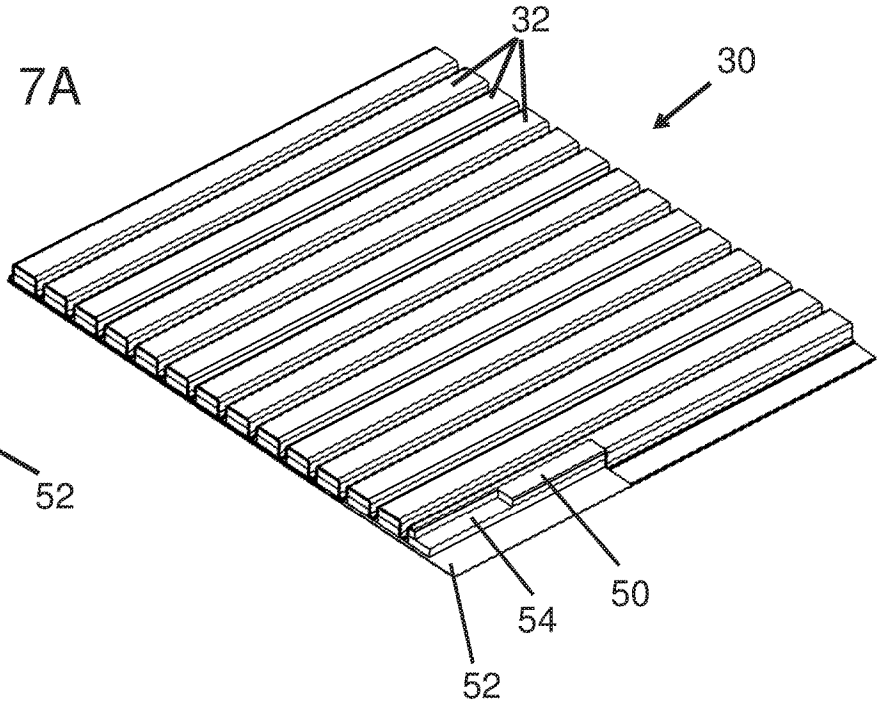
FIG. 7A-7C are partially cutaway, top plan, and end elevational views of an outer contact skin of the portable massage roller laid flat.
Figure 7C:
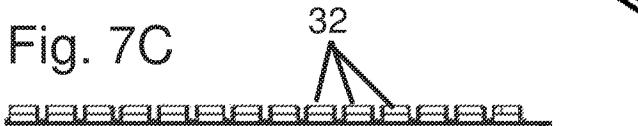
Figure 7B:
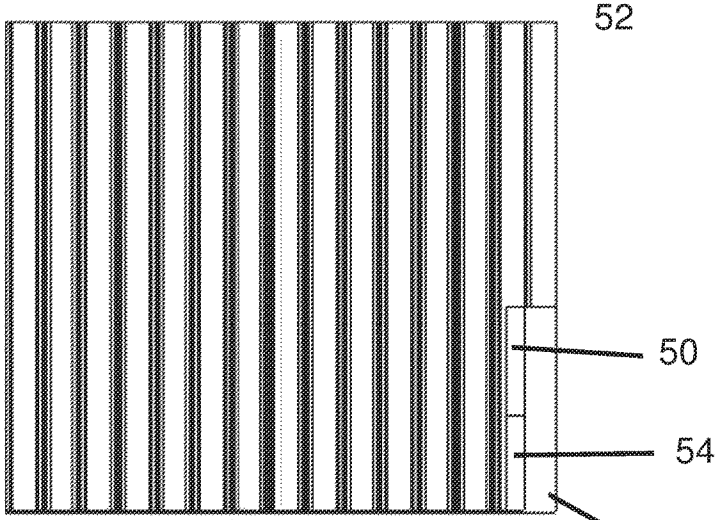
Figure 7D:
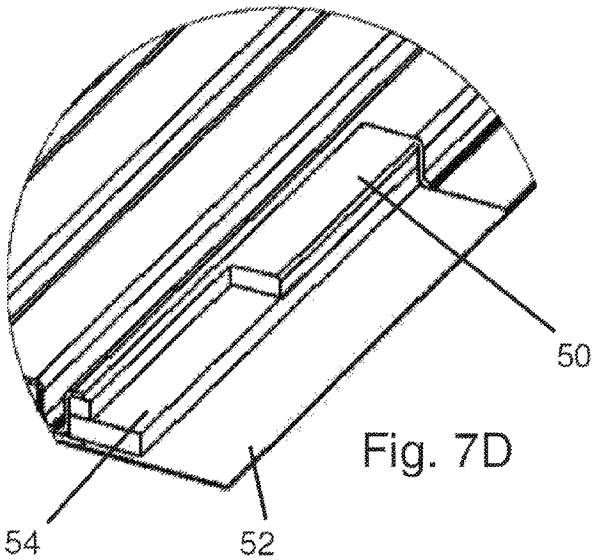
FIGS. 7D-7E are enlarged views of the contact skin showing exemplary constructional details.
Figure 7E:
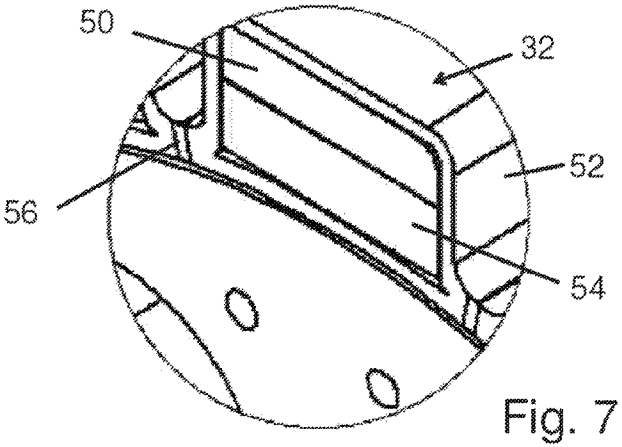

FIG. 7A-7C are partially cutaway, top plan, and end elevational views of an exemplary outer contact skin 30 of the portable massage roller laid flat, while FIGS. 7D-7E show certain constructional details enlarged. As will be apparent to one of skill in the art, the contact skin 30 can be used in conjunction with various collapsible structures described herein having circular or polygonal, stiffening discs, and vice versa. The contact skin 30 is constructed from two main elements: longitudinal stiffening bars 32 and a flexible connective material. The stiffening bars are formed by adhering a strip of compressible material 50 (e.g., foam) on top of a stiffening rib 54 (made of a strong but lightweight material like bamboo, fiberglass, PVC, aluminum, etc.). The bars 32 are likewise connected to each other by adhering them to (or inserting them into) a flexible material, such as formed by two pieces of fabric of various materials. The flexible material that occupies the space in-between the longitudinal stiffening bars acts as a hinge that allows the contact skin to take the form of the inner support structure when open, and lay flat when collapsed. The contact skin 30 may take a number of forms, whereas the exemplary assembly shows a number of stiffening bars sandwiched between two pieces of fabric. The fabric cover may be various types such as polyester, Nylon, Lycra, foam rubber, or canvas. In FIGS. 7D and 7E the components of the contact skin 30 are revealed to show that each compressible strip 50 lies on the outside of a longitudinal stiffening rib 54, both extending the length of the massage roller 20.

The fabric cover 52 surrounds each pair of compressible strip 50 and stiffening rib 54 such that they remain parallel to each other to define the series of the contact bars 32 around the roller 20. Flexible webbing 56 connects each of the contact bars 32 and maintains their constant spacing. In one embodiment, a plurality of combinations of compressible strips 50 and stiffening ribs 54 are covered on the inside by one sheet of fabric, and on the outside by a second sheet of fabric, and the flexible webbing 56 is formed by gluing or heat welding the two sheets of fabric together in between the strips and ribs. It should be noted that for comfort the bars 32 have soft, compressible outer surfaces, though the bars could also be made relatively hard while still performing in the massage roller 20. For example, the compressible strips 50 could be left out of the bars 32.

Figure 8A:
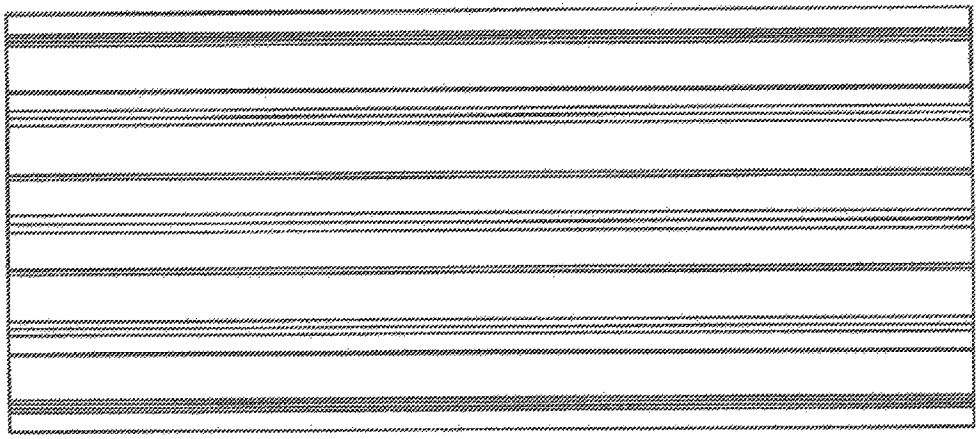
FIGS. 8A and 8B are side and end elevational views, respectively, of an alternative contact skin for use with the portable massage rollers disclosed herein.
Figure 8B:
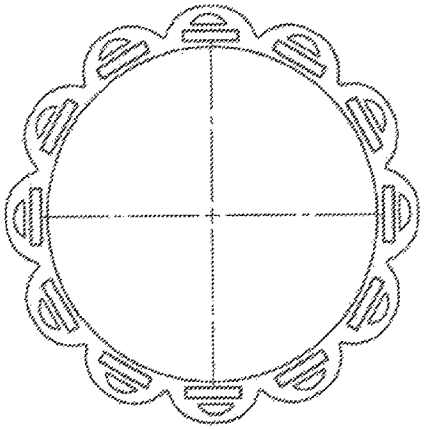
Figure 8C:
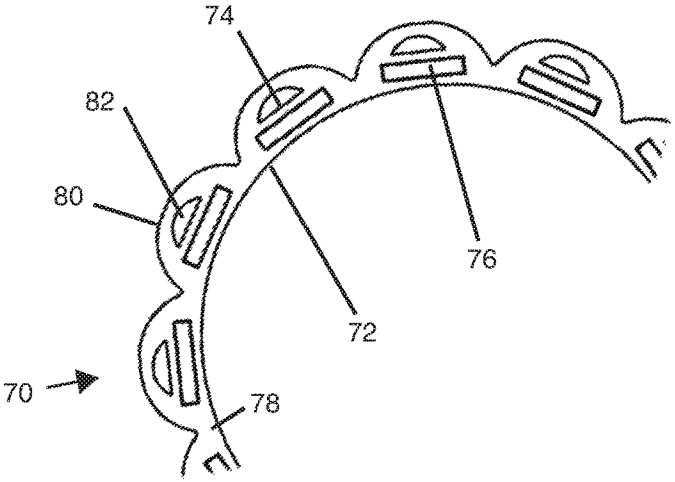
FIG. 8C is an enlarged end view of a portion of the contact skin showing stiffening elements assembled therewith.

FIGS. 8A and 8B are side and end elevational views, respectively, of an alternative contact skin 70 for use with the portable massage rollers disclosed herein. As with the earlier-described contact skin 30, a fabric, rubber, neoprene, foam, or other such flexible material forms an inner layer 72. FIG. 8C is an enlarged end view of a portion of the contact skin 70 showing stiffening ribs 76 assembled therewith. A series of circumferentially spaced tubes 74 or other such shapes define a plurality of cavities into which the longitudinal stiffening ribs 76 are inserted. Each of the tubes 74 encloses a rib 76 and is spaced from an adjacent tube across a living hinge or webbing 78 so that the contact skin 70 can be flexibly disposed around the inner collapsible structure. On the outside of the contact skin 70, rather than providing a solid piece of compressible material as before, an extension of the material of the tubes 74 defines an elongated bubble or cushion 80 with an inner cavity 82. The material of the cushion 80 is air-impermeable such that the inner cavity 82 remains inflated and provides a soft outer surface for the contact skin 70 which enhances the comfort of the user.

Figure 9A:
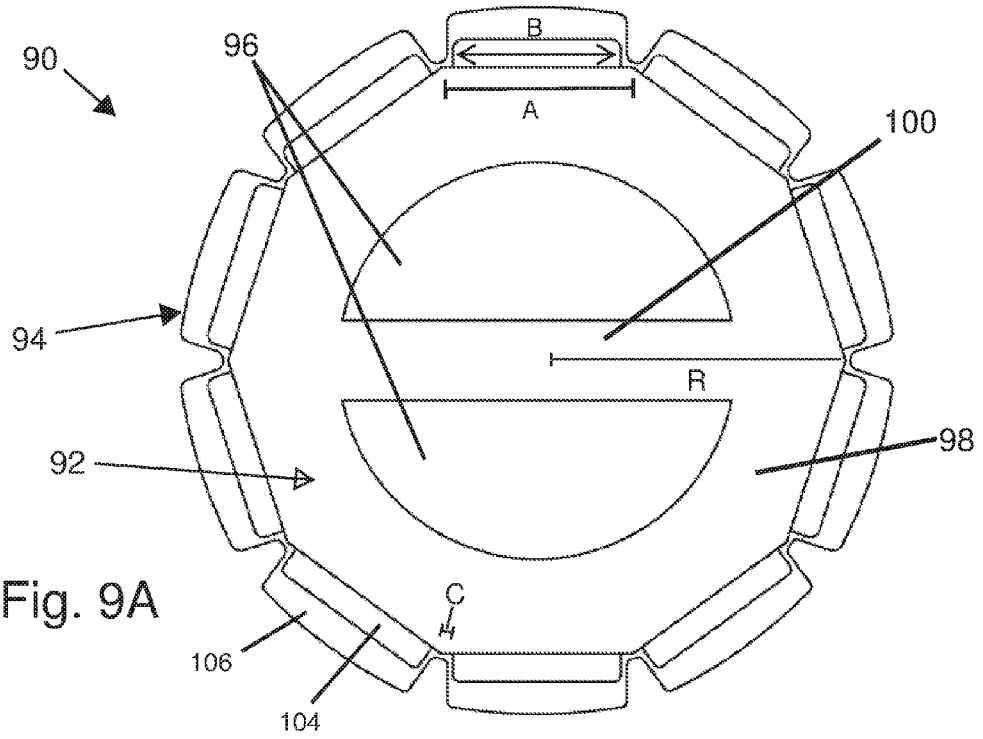
FIG. 9A is an end view of an alternative back roller having an internal decagonal stiffening disc.

FIG. 9A is an end view of an alternative back roller 90 having an internal polygonal stiffening disc 92. As will be apparent to one of skill in the art, the decagonal (10-sided) stiffening disc 92 can be used in the various collapsible structures described herein in place of circular stiffening discs, and vice versa. The stiffening disc 92 has a nominal radius R across its widest dimension of varying magnitudes, preferably between 5-10 cm. Each of the ten straight edges of the stiffening disc 92 has a dimension A that depends on the radius R. In an exemplary embodiment, the radius R is about 5.8 cm and the dimension A is about 36 mm. In that specific example, the overall diameter of the back roller is about 14.5 mm (5.7 inches). As explained elsewhere, there may be two, three, or more of the decagonal stiffening discs 92 in the massage roller 90 mounted at hinges (not shown) to enable collapse within an outer contact skin 94. To reduce the weight of the massage roller 90, each of the decagonal stiffening discs 92 includes internal cutouts 96 such that they are not solid plates. For example, the exemplary disc 92 shows two nearly semi-circular cutouts 96 formed by an outer ring 98 and a single stiffening spar 100 that is centered and extends straight through the center of the disc. Of course, other configurations are possible, such as having a more spoke-like shape, an internal "X" shape and the like.

Figure 9B:
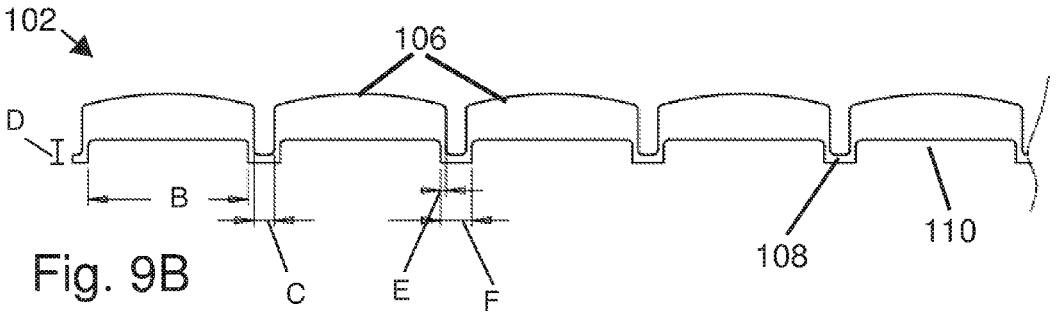
FIG. 9B is an end elevational view of an alternative cushion configuration for the contact skins disclosed herein.
Figure 9C:
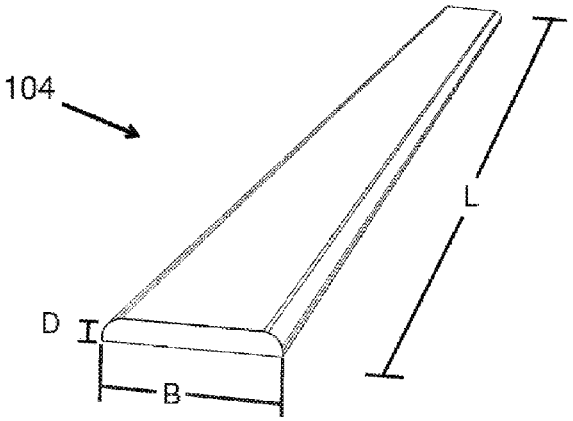
FIG. 9C shows a longitudinal stiffening rib for use therewith.

FIG. 9B is an end elevational view of an alternative cushion or foam pad 102 for use in the contact skin 94 of FIG. 9A, and FIG. 9C shows a longitudinal stiffening rib 104 for use therewith. The foam pad 102 is formed of a contiguous piece of compressible material, such as foam, having a series of pillows 106 and cavities 110 designated for the stiffening ribs 104. The material connecting the pillows is formed in a way to naturally create a living hinge 108 and allow the cushion to be flexible along the hinges. The outer contour of the pillows 106 is convex, while the inner generally rectangular cavity 110 provides room for the stiffening ribs 104. A fabric layer is desirably added to the topside of the compressible foam pad 102 to provide a protective layer for the compression material but is not necessary. In this particular embodiment, the contiguous foam pad 102 could be formed into two pieces for the two sides of the collapsing structure, or could be a single pad that is formed to encapsulate all of the stiffening ribs 104 around the inner support structure.

The contact skin 94 includes the continuous compressible pad 102 with the longitudinal stiffening ribs 104 fit into the inner cavities 110 so as to make the pad and ribs become one contiguous unit. The stiffening ribs 104 are desirably secured in the cavities 110 with adhesive, or the like, and then directly contact each of the outer straight edges of the stiffening disc 92, as seen in FIG. 9A. In this manner, the weight of a person on the massage roller 90 is transmitted through the stiffening ribs 104 to the internal stiffening discs 92. The materials for the components of the massage roller 90 are desirably lightweight, such as aluminum stiffening discs 92, bamboo stiffening ribs 104, and close-celled polyethylene or EVA foam for the pad 102. In the exemplary model, a non-elastic fabric is bonded to the underside of the pad to provide further structural support to the contact skin 94. The fabric connects the longitudinal stiffening ribs 104 together in order to maintain their constant spacing, allowing them to remain parallel. The fabric cover may be made of various materials such as polyester, Nylon, Lycra, foam rubber, or canvas.

Exemplary dimensions are indicated in FIGS. 9A-9C. In one embodiment, where the radius R of each stiffening discs 92 is 5.8 cm, the width B of each stiffening rib 104 matches the width of the inner cavities 110, and is about 30 mm. A circumferential spacing C between each of the pillows 106 is about 3 mm. The depth D of the inner cavities 110 desirably matches the thickness of each of the stiffening ribs 104, and is about 4 mm. In the exemplary embodiment, a length L of the stiffening ribs 104 is about 38 cm, but this may be easily varied. In an exemplary embodiment, the span F between the stiffening rib cavities is about 6 mm.

FIG. 9A also shows an alternative design for the end support disc 92 whereby a user could open the structure by pulling on the cross bar section 100 rather than using pullers or cords as described below. Of course, other configurations are possible, such as having a more spoke-like shape, an internal "X" shape and the like.

Figure 10A:
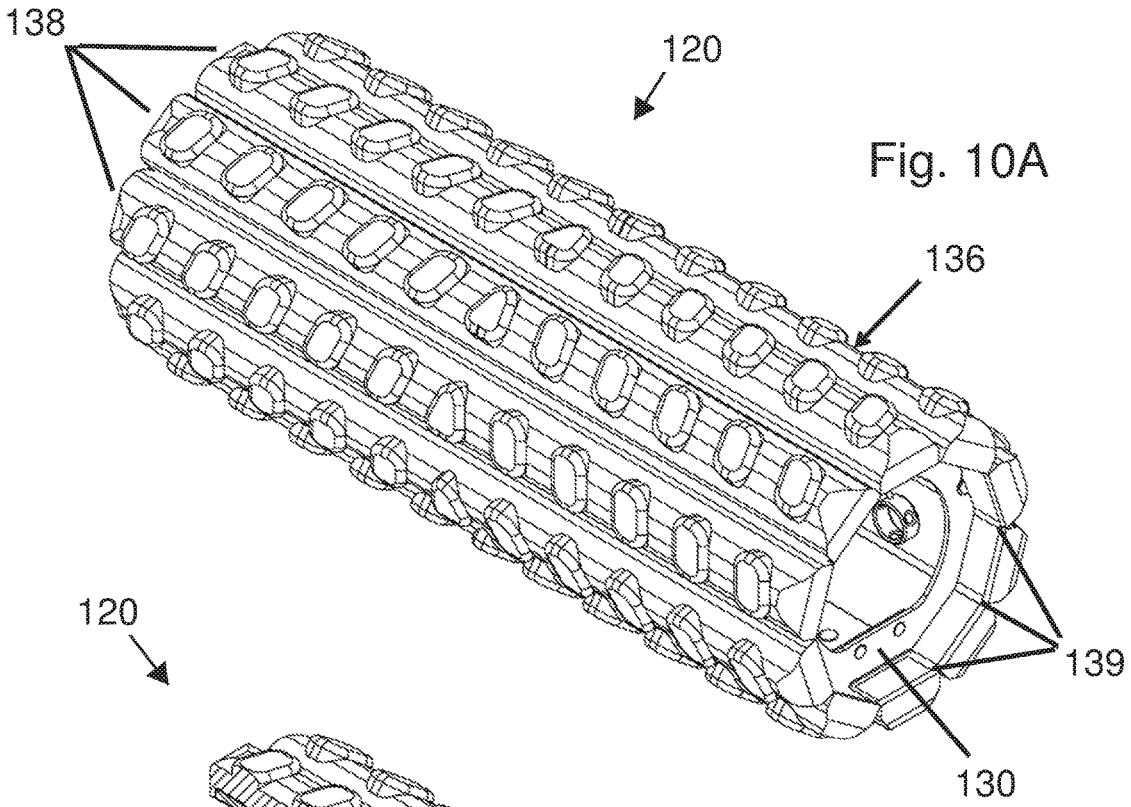
FIG. 10A is a perspective view of a further exemplary portable massage roller.
Figure 10B:
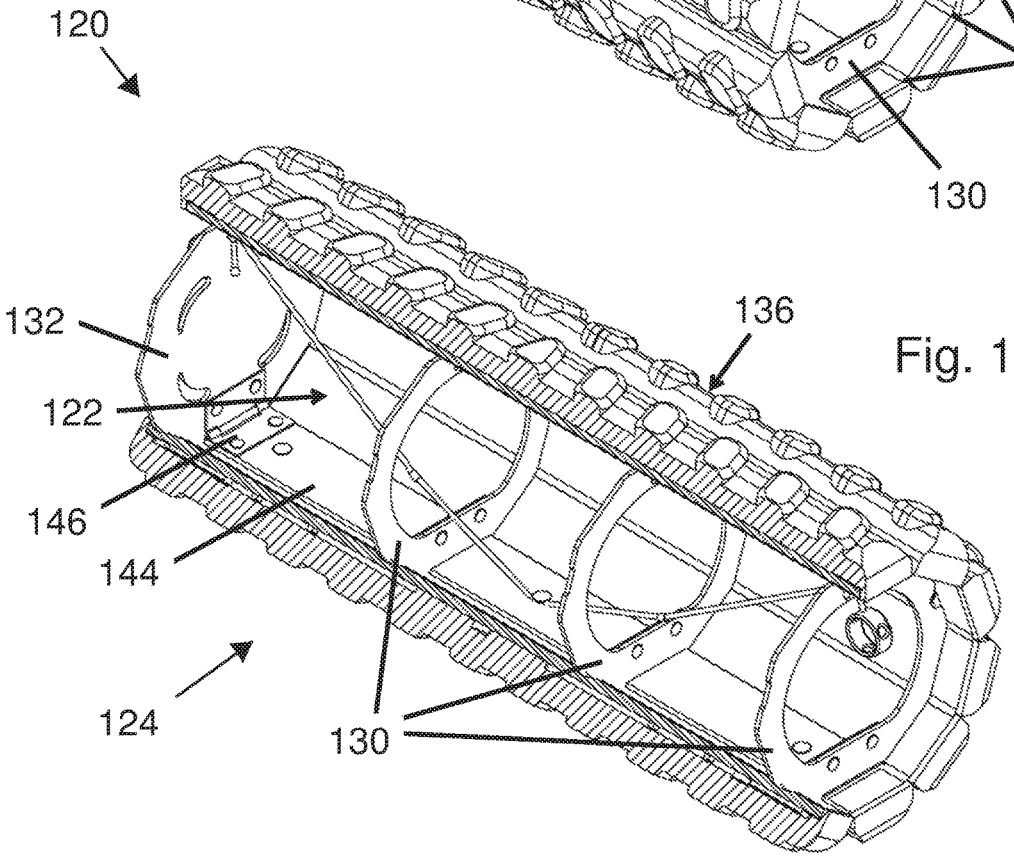
FIG. 10B is a cutaway view of the massage roller exposing internal stiffening discs and ribs.
Figure 11E:
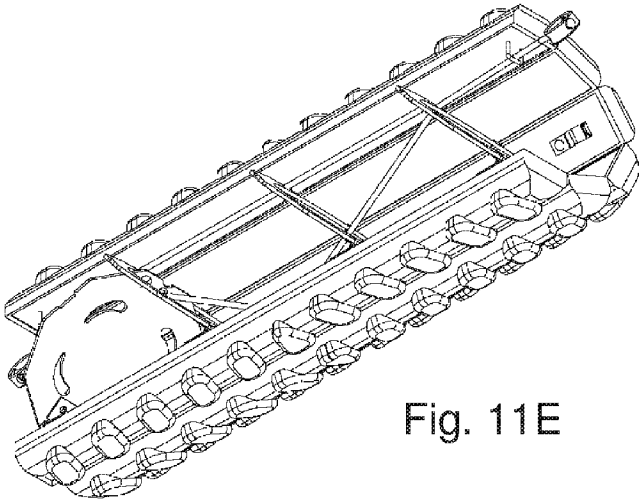
Figure 11F:
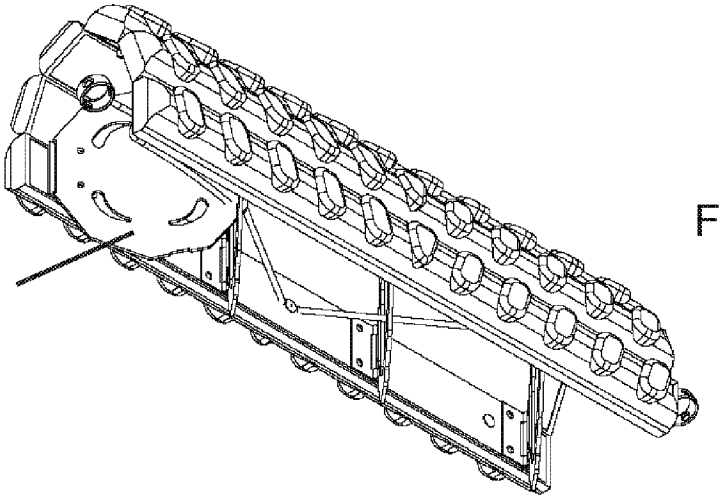
Figure 11D:
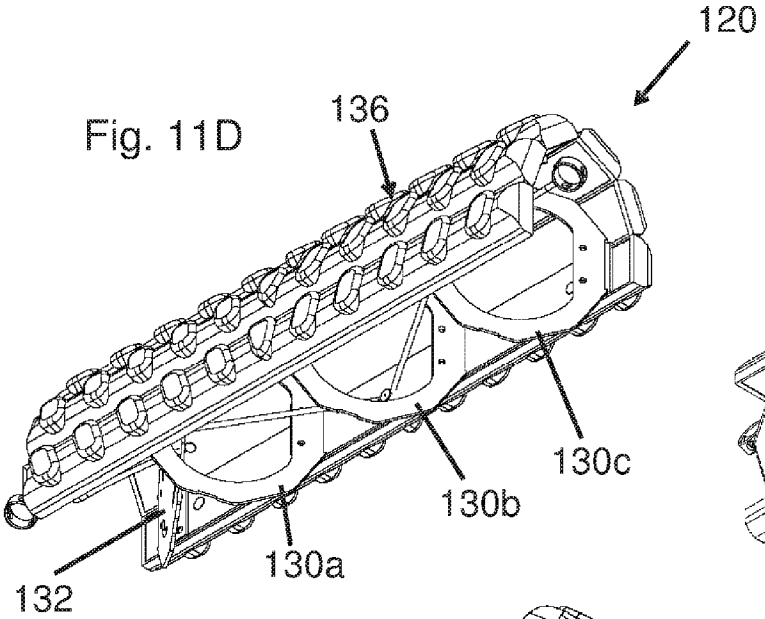

FIG. 10A illustrates another exemplary portable massage roller 120 in an expanded configuration, while in FIG. 10B a portion of the roller is cut away to expose an inner cavity 122 within which is mounted an internal collapsible support structure 124 comprising stiffening discs 130, 132. The massage roller 120 has two main components, an outer contact skin 136 and the internal collapsible support structure 124. The outer contact skin 136 is desirably padded to provide a surface suitable for foam rolling.

In the expanded configuration, the massage roller 120 has a generally cylindrical external shape with a length along a longitudinal axis and a diameter that may vary greatly. In an exemplary embodiment, the diameter of the massage roller 120 is between 5-7 inches (~13-18 cm), and has a length of between 14-36 inches (~35-91 cm), for example. Preferably, the massage roller 120 is made of lightweight materials, such that the smallest roller weighs less than 2 pounds, while the largest embodiment weighs no more than 4 pounds.

With reference to FIGS. 10A-10F, the outer skin 136 of the massage roller 120 desirably comprises a plurality of axially-oriented bars (longitudinal stiffeners) 138 that extend the full length of the roller and are connected by longitudinally-extending hinge points 139. As will be explained, the bars 138 are supported by the internal stiffening discs 130*a*, 130*b*, 130*c* and 132 spaced within the roller such that the entire assembly is sufficiently strong enough to withstand the force transmitted through the longitudinal stiffeners to the inner support structure from someone lying, kneeling, or standing on the roller 120. In the illustrated embodiment, there are four stiffening discs 130/132, with one at each end thereof and two intermediately spaced therebetween. As shown in FIGS. 10D and 10E, the stiffening discs are shown having a polygonal (e.g., decagonal) outer contour, with three of the discs 130*a*, 130*b*, 130*c* having a large central cutout 140 and one of the discs 132 having a series of small cutouts 142 to reduce the overall disc weight. It should be noted however that the cutouts are not necessary to the operation of the collapsible foam roller.

The stiffening discs 130/132 each has a nominal diameter D across its widest dimension of varying magnitudes, preferably between 8-20 cm. Each of the ten straight edges of the stiffening disc 130/132 has a dimension A that depends on the diameter D. In an exemplary embodiment, the diameter D is about 11.6 cm and the dimension A is about 32 mm. The overall diameter of the back roller 120 including the outer padded skin 136 is about 14.5 mm (5.7 inches).

With particular reference to FIG. 10B, and also as shown in FIGS. 11A-11F, the exemplary assembly of internal stiffening discs 130*a*, 130*b*, 130*c* and 132 will be described. As mentioned, there are preferably four stiffening discs arrayed along the length of the massage roller 120, although this number may vary. The stiffening discs 130/132 are connected to each other via a longitudinal spar 144 that also extends substantially the length of the massage roller. Each of the discs 130/132 connects to the spar 144 by a hinge 146 or pivot point, and thus one diametric edge of each disc is fixed axially with respect to the others. The longitudinal spar 144 is in turn secured to an inner surface of the contact skin 136 by various means, including adhesive, fasteners, rivets, etc. In this way, each of the stiffening discs 130/132 is hinged relative to a fixed point within the inner cavity of the contact skin 136 with the collapser disc 132 hinged in one direction while the three common discs 130*a*, 130*b*, 130*c* are hinged in the opposite direction. That is the hinges 146 permit pivoting in one direction only. Though the exemplary assembly shows the support discs connected along the common spar and hinged accordingly, it is not necessary for the support discs to be connected or hinged, and they could alternatively be independent of each other. For example, the independent support discs could be inserted individually into the contact skin and fastened into place by various methods in order to support the expanded foam roller.

Figure 13A:
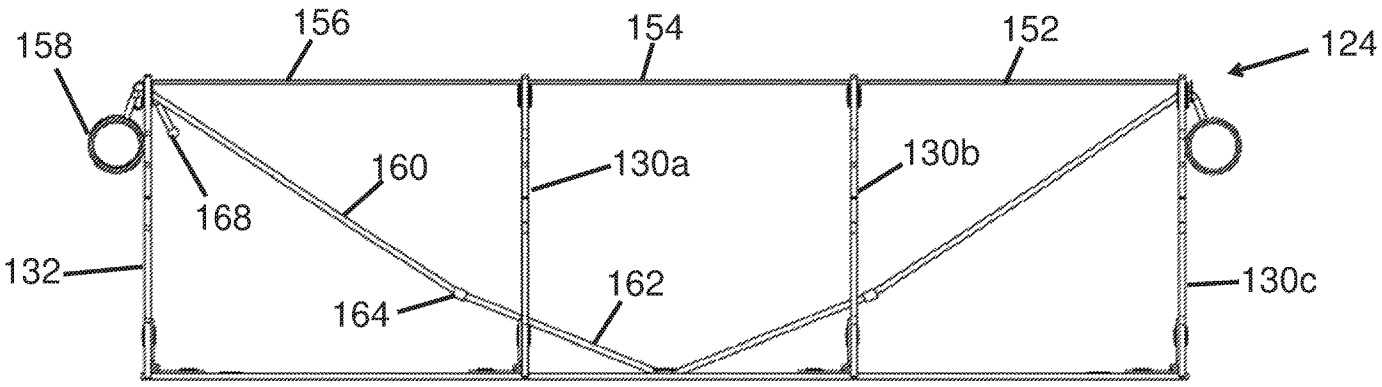
FIGS. 13A-13C are schematic side views of an internal collapsible support structure in a sequence from their expanded configuration to their collapsed configuration and highlighting a set of rigging wires used to collapse the structure.
Figure 14A:
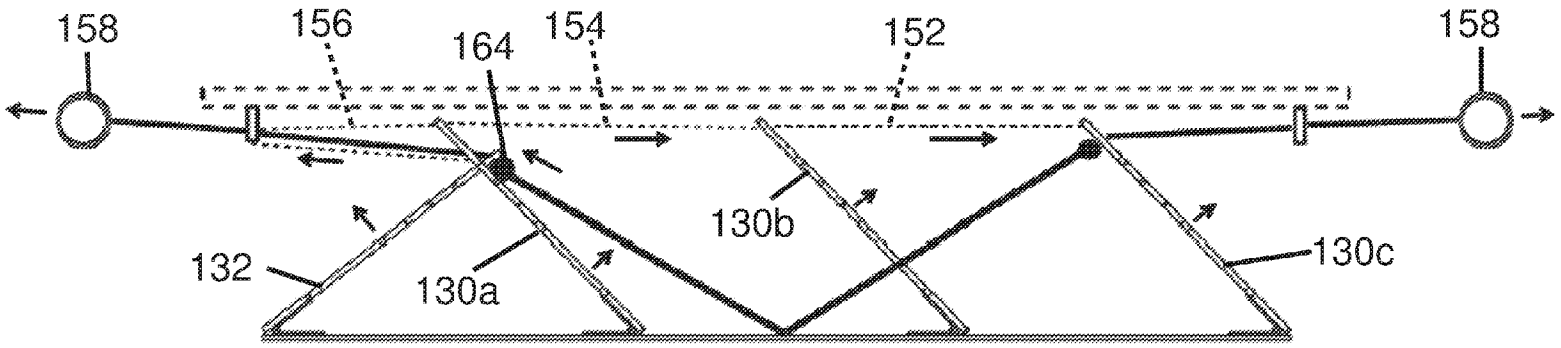
FIGS. 14A-14B illustrate the internal collapsible support structure in a sequence when expanding from its collapsed position.
Figure 14B:
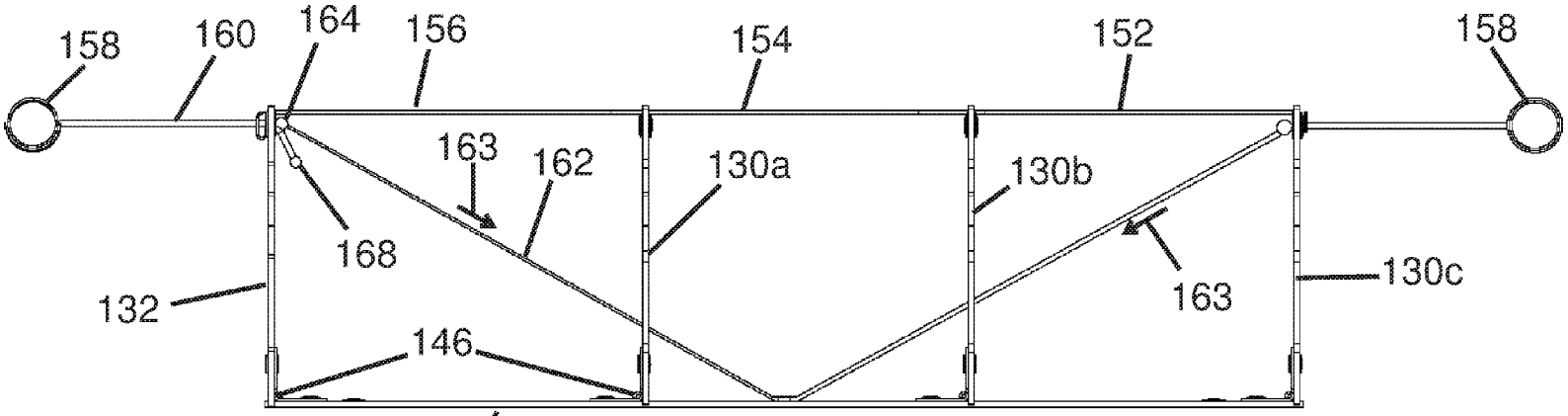

In FIGS. 10A-10F, as well as in FIGS. 13A and 14B, the exemplary embodiment of stiffening discs 130/132 are displayed in their expanded, upright position, generally perpendicular to a longitudinal axis of the roller 120. As shown, the discs are coupled to each other via a wire rigging system whereby two wires 152, 154 connecting the three common discs 130*a*, 130*b*, 130*c* support each other in this expanded configuration when the roller is being used. A third wire, the so called "collapser wire" 156, connects the collapser disc 132 to the common disc 130*a*. The collapser wire 156 is slightly loose in this expanded position. Thereby, all four discs are connected via this "operational" rigging system and will collectively collapse together when a user pushes on the single collapser disc 132, as will be explained further.

A secondary, "expansion" rigging system is also shown. This rigging system is used to expand the roller from the collapsed position. The expansion rigging system contains a set of pullers 158 that are attached to a non-elastic cord 160. The non-elastic cords 160 are attached on the other end to elastic cording 162, such as a bungee cord. At the attachment point between the non-elastic cord 160 and the elastic cord 162, a ball crimp, knot, or otherwise semi-bulky connection point 164 is used.

In FIG. 10B, a so-called "collapser disc" 132 is shown in its expanded position, radially supporting the outer contact skin 136. As will be described herein, the collapser disc 132 is designed with minimal cutouts 142 in order to provide a larger surface area. The increased surface area of this disc 132 allows a user to more easily push on it in order to collapse the structure. The act of pushing on the collapser disc 132 works to collapse the entire assembly by, at once, reorienting the collapser disc to the flat position, while at the same time pulling the other, so called, "common discs" 130*a*, 130*b*, 130*c* in the opposite direction so that they also lie flat, with one of the common discs 130*a* lying on top of the collapser disc 132. Of course, the number and configuration of stiffening discs 130/132 may vary depending on the length of the roller 120 and the particular construction of the collapsible support structure 124. Alternative configurations are described below.

Figure 12B:
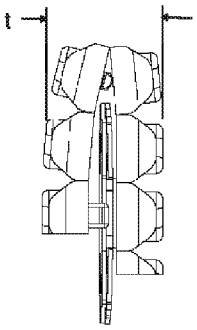
FIGS. 12A-12D are various external partly cutaway views of the portable massage roller in its collapsed, flattened configuration.
Figure 12A:
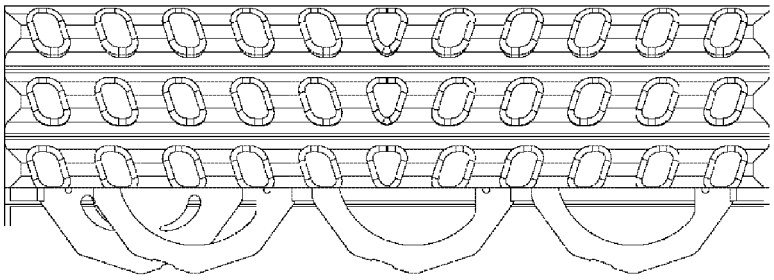
Figure 12C:
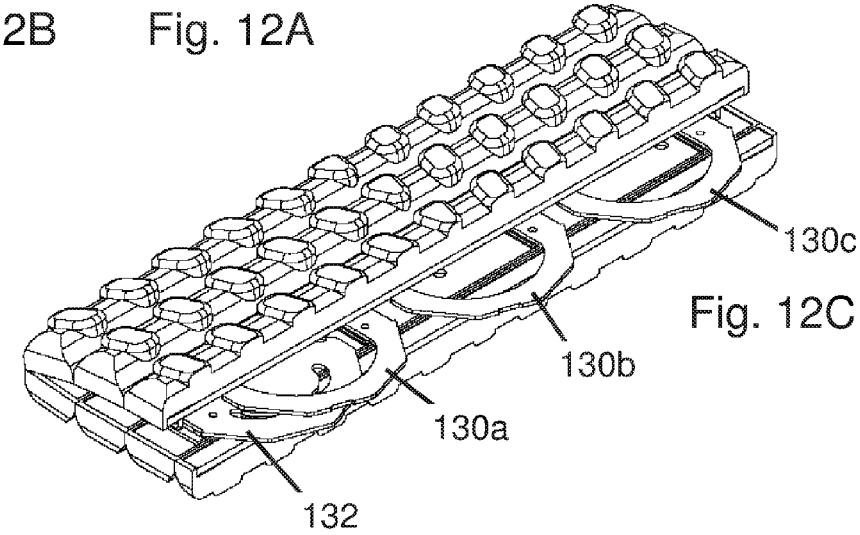
Figure 12D:
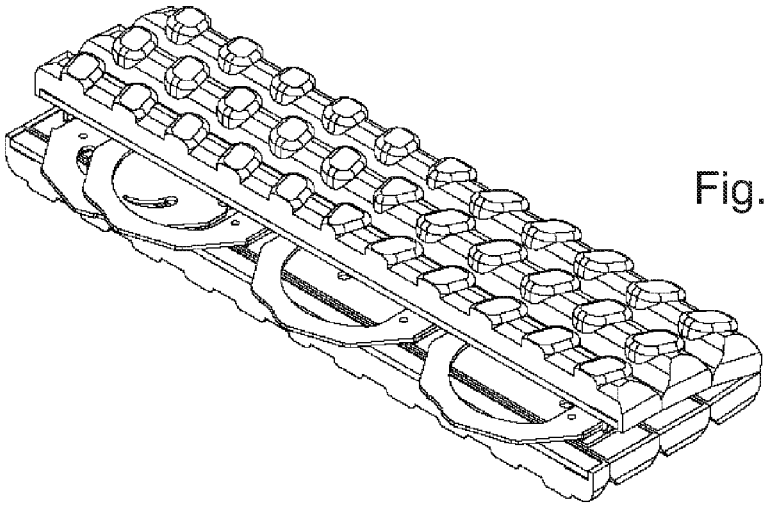

FIGS. 11A-11F show the portable massage roller 120 in a partially collapsed position, while FIGS. 12A-12D show the roller in the fully collapsed position. FIGS. 12C-12D show how the collapsed internal stiffening discs 132 lie flat within the inner cavity of the contact skin 136. While in the expanded configuration the outer contact skin 136 is substantially tubular. When collapsed, the outer skin flattens into approximately an elliptical or rectangular shape. Of course, because of the presence of the internal collapsible structure 124, and the discontinuous outer surface formed by the longitudinal bars 138, the shape of the contact skin 136 is not precisely elliptical. The ability to flatten the massage roller 120 greatly reduces its total volume, and permits it to be easily stored in a closet or packed in a suitcase or other such travel container without taking up too much room. In one example, the total thickness t of the massage roller 120 in its collapsed configuration, as shown in FIG. 12B, is no more than twice the thickness of the contact skin 136 plus the thickness of the collapsed support structure 124. For example, the total thickness t is approximately 2 inches (~5-8 cm).

Figure 13B:
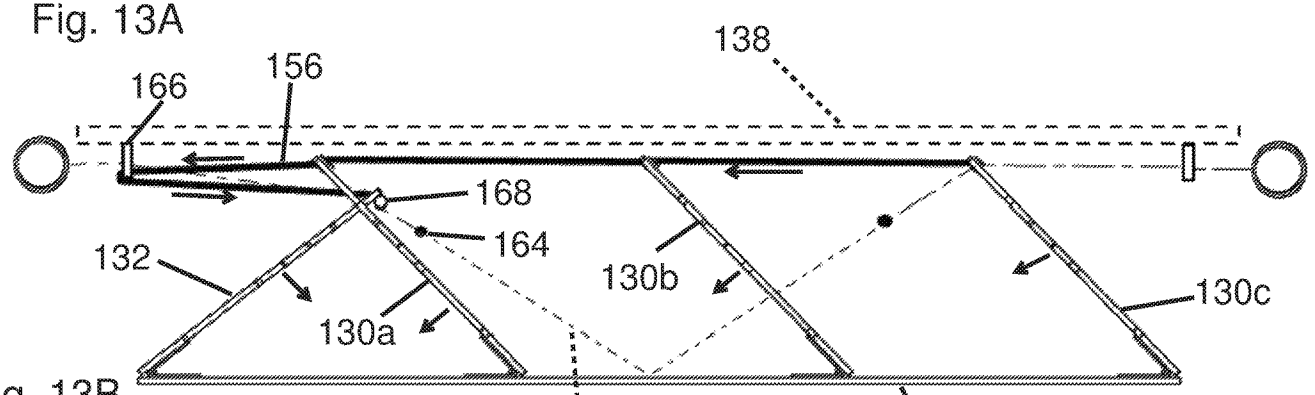
Figure 13C:
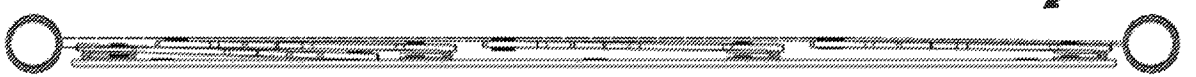

FIGS. 13A-13C and 14A-14B show, in sequence, a schematic side view of the mechanisms by which the internal support structure 124 is first collapsed and then expanded. In FIG. 13A, the support structure is in its expanded configuration. The collapser wire 156 is shown attached on one side to common disc 130*a*, routing over the collapser disc 132, through and around the rigging loop 166, and back through the collapser disc 132, where a ball crimp, bead, knot, or otherwise semi-bulky endpoint 168 is left with some slack inside the collapser disc. As seen in FIG. 13B, when a user pushes inward on the collapser disc 132, which is exposed at one end of the roller 120, the slack in the collapser wire 156 allows the collapser disk 132 to be pushed a predetermined distance before the endpoint 168 contacts the disc. Since the collapser wire 156 is strung around the rigging loop 166 it eventually becomes taught and starts to pull the common disc 130*a* in the opposite direction towards the collapsed position (arrows in FIG. 13B). The collapser disc 132 is at this point, already in the semi-collapsed position and the common disc 130*a*, at a less collapsed position, will thereby collapse on top of the collapser disc as the entire assembly is collapsed to the flat position. The large cutout 140 in the common disc 130*a* receives some overlap of the collapser disc 132 to avoid binding. Common discs 130*b* and 130*c* are spaced so that they will lie flat along the common spar 144 in the fully collapsed position, FIG. 13C. In this way, the user can quickly and predictably collapse the entire assembly by simply pushing on the single collapser disc 132.

The expansion rigging system is described by FIGS. 14A and 14B. When a user wishes to expand the collapsible support structure 124 (and roller 120) from the collapsed/flat position (FIG. 13C), he/she will grip the pullers 158 and pull them in opposite directions (arrows in FIG. 14A). The semi-bulky connection point 164 between the elastic cord 162 and the non-elastic cord 160 works as an internal fixed point on the two end discs 132 and 130*c* and pulls the two discs to the expanded position. The two operational rigging wires 152, 154 that connect the three common discs 130*a*, 130*b*, 130*c*, act to pull the two inner common discs 130*a* and 130*b* to the expanded/upright position along with the end common disc 130*c* as the pullers 158 are pulled outward. Finally, in the expanded position, as shown in FIG. 14B, the elastic cords 162 serve to retract the pullers 158 back towards the outer discs so that they are not loose during roller operation (as shown by the force arrows 163). This keeps the lengths of the non-elastic cords 160 short outside of the end discs.

Figure 15A:
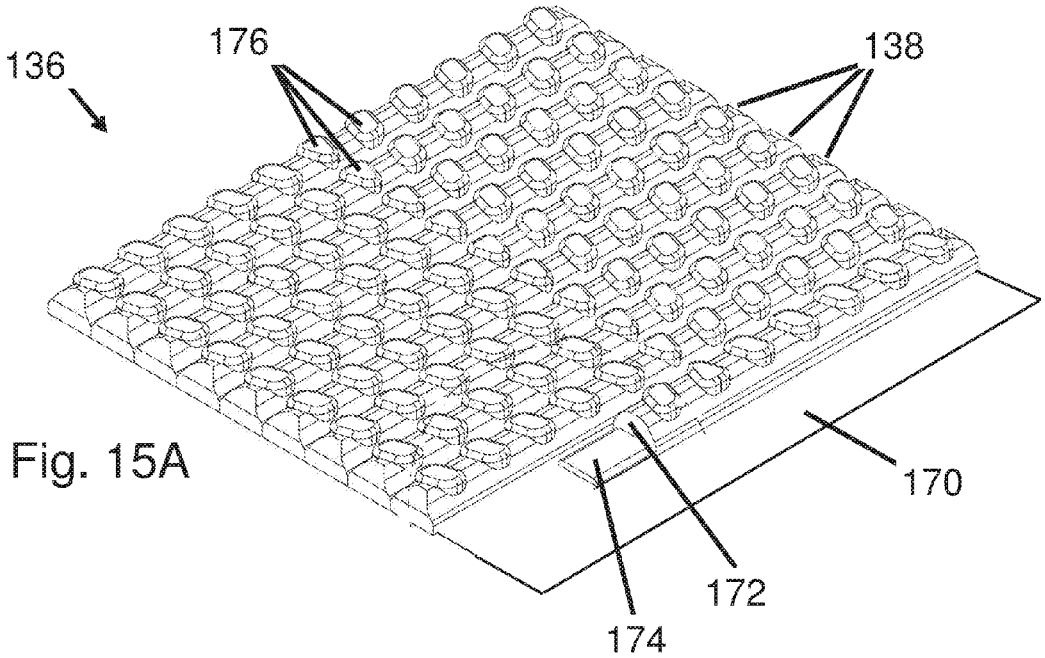
FIG. 15A-15B are partially cutaway, perspective, and end elevational views of an outer contact skin of the portable massage roller laid flat.
Figure 15B:
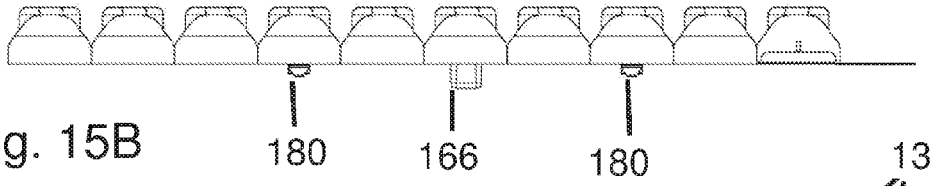
Figure 15C:
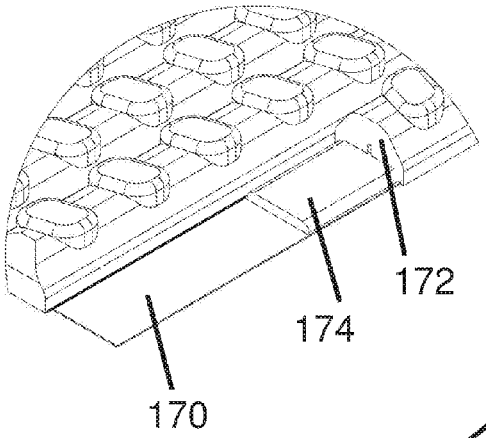
FIG. 15C is an enlarged view of the contact skin showing exemplary constructional details.
Figure 15D:
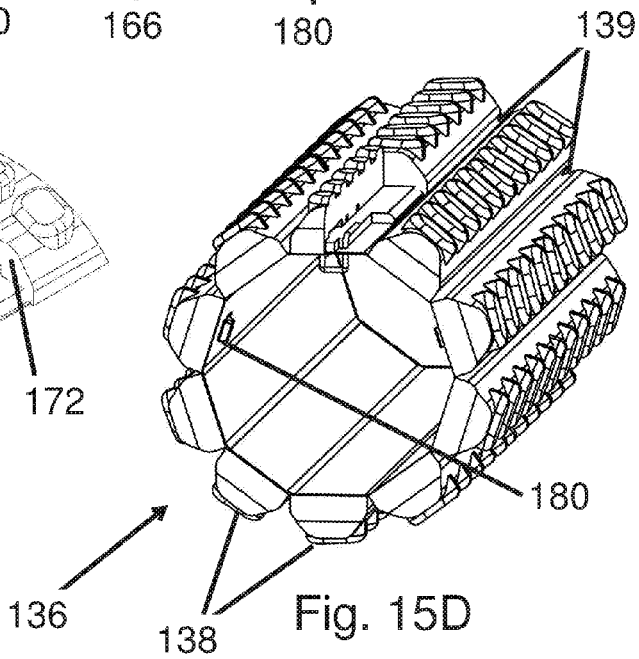
FIG. 15D shows the outer contact skin in its rounded configuration.

FIG. 15A-15C are partially cutaway, perspective, end elevational, and enlarged views of an exemplary outer contact skin 136 of the portable massage roller laid flat, while FIG. 15D shows the contact skin in its rounded configuration without the internal support structure. The contact skin 136 is constructed from two main elements: the longitudinal stiffening bars 138 and a flexible connective material 170. The stiffening bars 138 are formed by adhering a strip of compressible material 172 (e.g., foam) on top of a stiffening element or rib 174 (made of a strong but lightweight material like bamboo, fiberglass, PVC, aluminum, etc.). The bars 138 are likewise connected to each other by adhering them to the flexible material (e.g., fabric, foam, or rubber) 170. The flexible material 170 that occupies the space in-between the longitudinal stiffening bars acts as the longitudinally-extending hinge points 139 that allows the otherwise sheet-like contact skin to take the cylindrical form of the inner support structure when open, and lay flat when collapsed. Axial ends of a sheet of the contact skin 136 (such as seen in FIG. 15A) are attached together with adhesive or the like and the resulting closed shape can convert between the tubular roller shape and the flattened collapsed shape.

The contact skin 136 may take a number of forms. The exemplary assembly shows a series of ten stiffening bars 138, each consisting of a stiffening rib 174 (in this case a bamboo strip) which is encapsulated in a foam pad 172. The foam pad 172 is shown with a series of molded protrusions or bumps 176 on the outside surface that are designed to enhance the rolling experience. The stiffening bars 138 are individually adhered to a flexible membrane 170 such as Nylon, polyester, foam rubber, or canvas so that they remain parallel to each other and define a series of contact bars 138 around the roller.

Several methods have been considered for locking the expanded support structure in the open position. In a similar manner as described above, the current configuration provides a series of spring clips 180 secured inside the contact skin. FIG. 15D, shows a view of the contact skin 136 in its expanded position with the support structure removed. On the inside surface of the outer contact skin 136 can be seen a series of two clips 180 and a metal loop 166, referred to as a "rigging loop" (described above with reference to FIGS. 13-14). Each element is 180, 166 may be adhered to the contact skin by various means. All three elements 180, 166 are collectively used to stop the stiffening discs in a predetermined position when a user expands the roller from the collapsed position. With particular reference to the clips 180, they are designed in a way that also prevents the support structure 124 from collapsing inwardly during roller operation. That is, as seen in FIG. 10F, the outer discs 130*c*, 132 pivot outward past the clips 180 which flex outward and then provide a nominal resistance to reverse collapse of the support system 124. The rigging loops 166 are also used to channel and provide function to the two internal rigging systems, as was described above.

For example, FIGS. 15B and 15D illustrate flat-spring metal clips 180 that are used to stop and lock the discs 132 and 130*c* in the expanded position. They are attached to the longitudinal stiffener 138 on the inside surface of the outer contact skin 136 so that the two end discs 130*c* and 132 can contact them at just past 90°. By allowing the discs to open at slightly past 90 degrees, the user's weight will effectively and continuously push the discs towards the open position and thereby hold the support structure open. In addition, the shape of the spring clips 180 work as a fail-safe to make sure the structure doesn't collapse unintentionally during user operation.

Figure 16A:
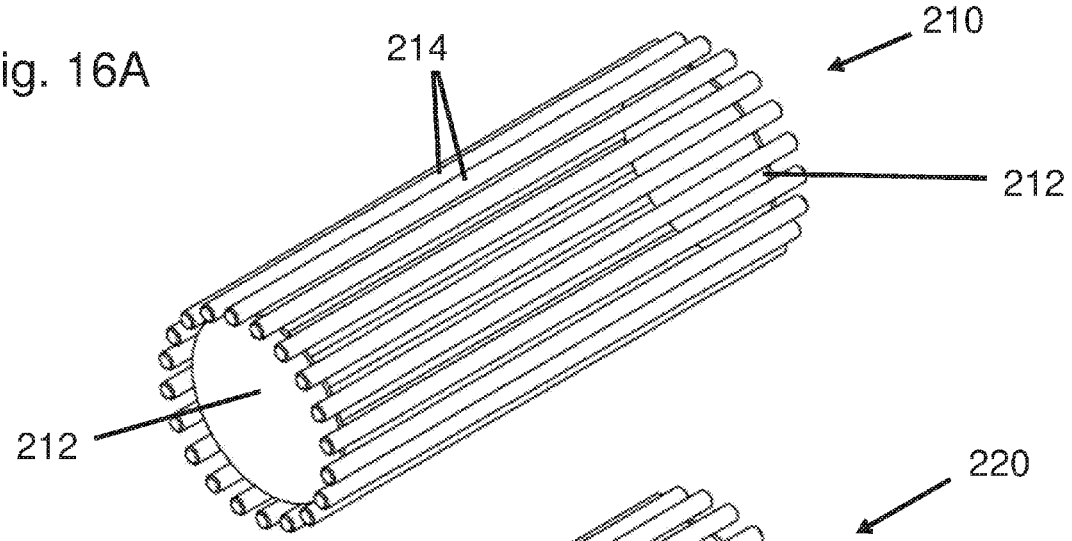
FIGS. 16A-16C are perspective skeletal views of three other alternative configurations of portable massage rollers disclosed in the present application.
Figure 16B:
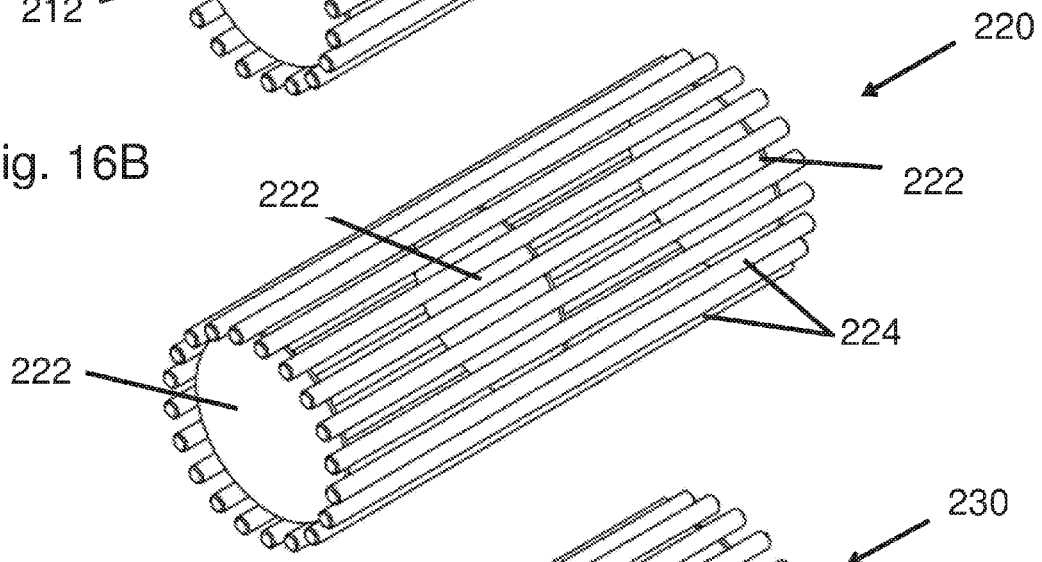
Figure 16C:
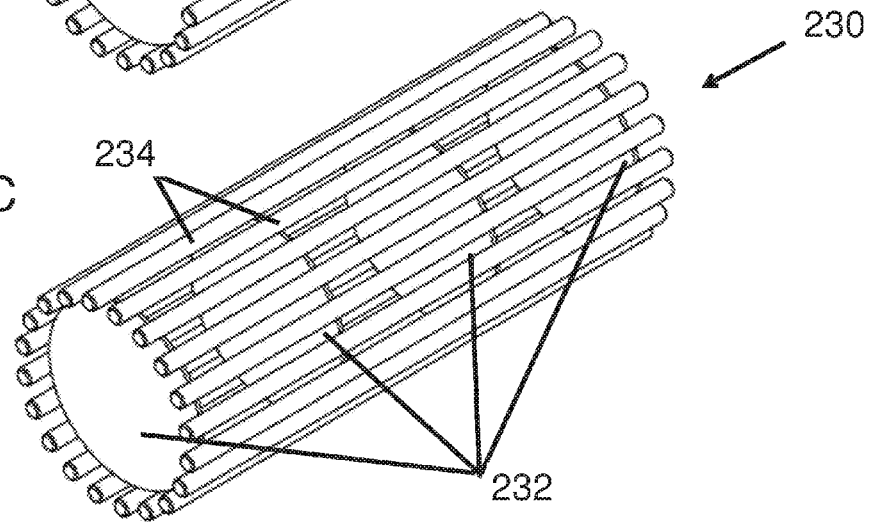

FIGS. 16A-16C are perspective skeletal views of three other alternative configurations of portable massage rollers 210, 220, 230. The first roller 210 includes just two internal stiffening discs 212 on either end of the roller. A series of longitudinal stiffening ribs 214 extends the length of the roller and contacts the outer edge of each of the discs 212. The second roller 220 includes three evenly spaced stiffening discs 222 supporting an outer tubular array of longitudinal stiffening ribs 224. Finally, the third roller 230 has four evenly spaced stiffening discs 232 internally supporting the longitudinal stiffening ribs 234. The schematic illustrations of the basic skeletal structure of alternative back rollers is provided to indicate several possible configurations, although they should not be considered limiting.

Figure 17A:
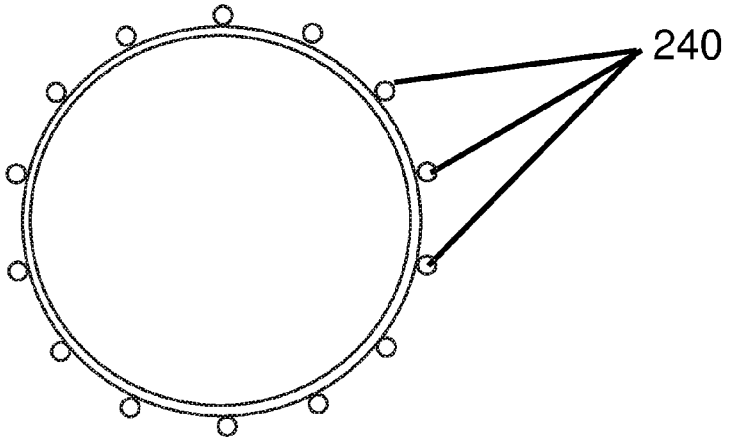
FIGS. 17A-17C are end views of alternative configurations of stiffening ribs.
Figure 17B:
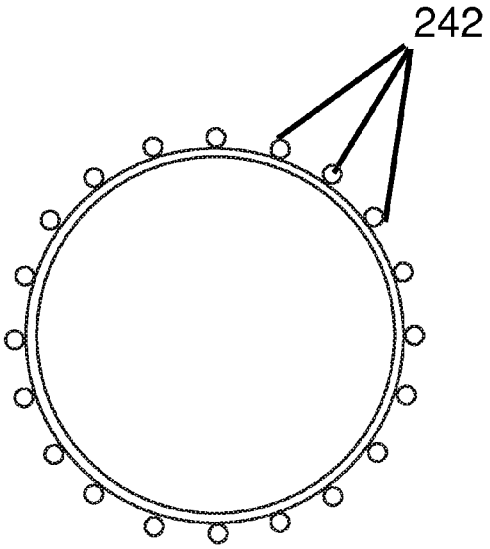
Figure 17C:
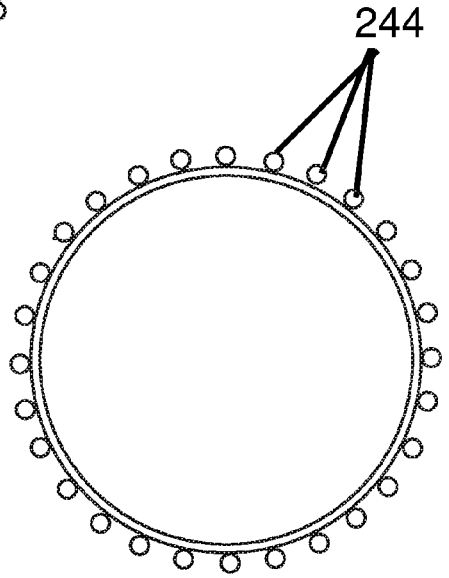

Furthermore, the number of longitudinal stiffening ribs can also be varied. FIGS. 17A-17C are end views of alternative configurations of stiffening ribs. In FIG. 17A there are fourteen stiffening ribs 240 evenly spaced around circumference of a back roller. FIG. 17B illustrates twenty evenly-spaced stiffening ribs 242, while FIG. 17C shows twenty-eight stiffening ribs 244. The stiffening ribs 240 are illustrated more as a rod-like elements, rather than plates or strips as described above. The diameters of the rod-like stiffening ribs 240, 242, 244 may vary between 6-15 mm, partly depending on the number of the ribs. For example, 28 of ¼ inch stiffening ribs 244 in FIG. 17C may be used, while the fourteen stiffening ribs 240 in FIG. 17A having diameters of ½ inch may be used.

The present application contemplates a collapsible support structure disposed within the outer contact skin inner cavity and sized to contact and radially support the contact skin in its expanded configuration, and adapted to convert the contact skin between its expanded and collapsed configurations. There are numerous ways to configure such a support structure, including using the rigid inner discs as shown herein. Furthermore, an inflatable inner structure is contemplated that provides adequate radial support to the outer contact skin having longitudinal stiffeners. An inflatable inner support structure or bladder would require a certain minimum pressure capacity to withstand the pressures to which it was subjected when in use.

Figure 18B:
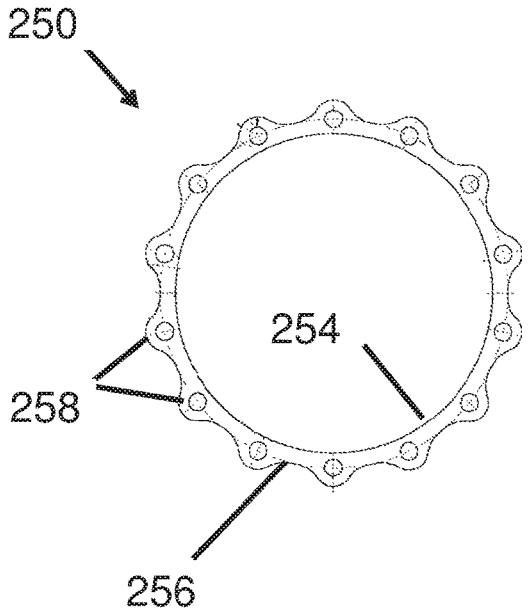
FIGS. 18A-18B are perspective, and end views of a still further alternative unitarily single piece contact skin assembly that may be used with collapsible stiffeners as described herein.
Figure 18A:
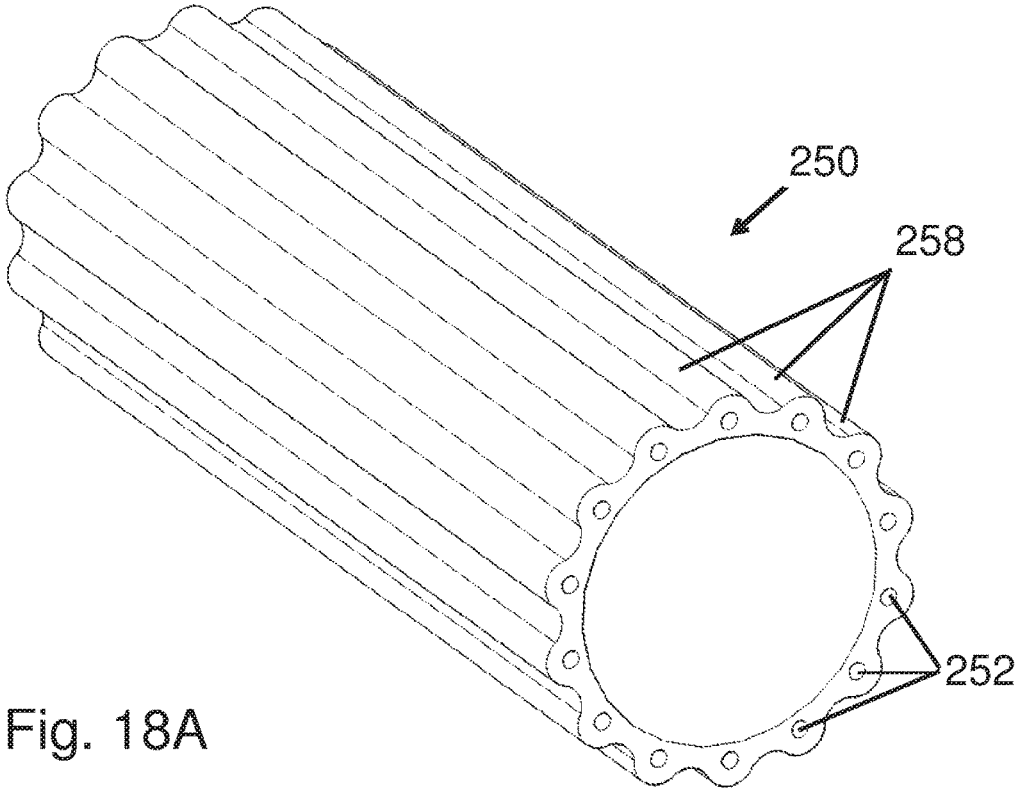

FIGS. 18A and 18B show an alternative contact skin 250 assembly for use with the skeletal structures of FIG. 16A-16C, for example. The contact skin 250 comprises a single molded tube of compressible material such as a foam-rubber having a series of longitudinal channels 252 formed therein. More particularly, as seen in FIG. 18B, an inner wall 254 of the contact skin 250 is circular to provide an inner tubular contour to receive stiffening discs as described above. An outer wall 256 of the contact skin 250 defines a series of longitudinal bumps 258 at the location of each of the longitudinal channels 252. Cylindrical stiffening ribs such as the rod-like stiffening ribs 234 from FIG. 16C can then be inserted into the longitudinal channels 252.

Figure 19A:
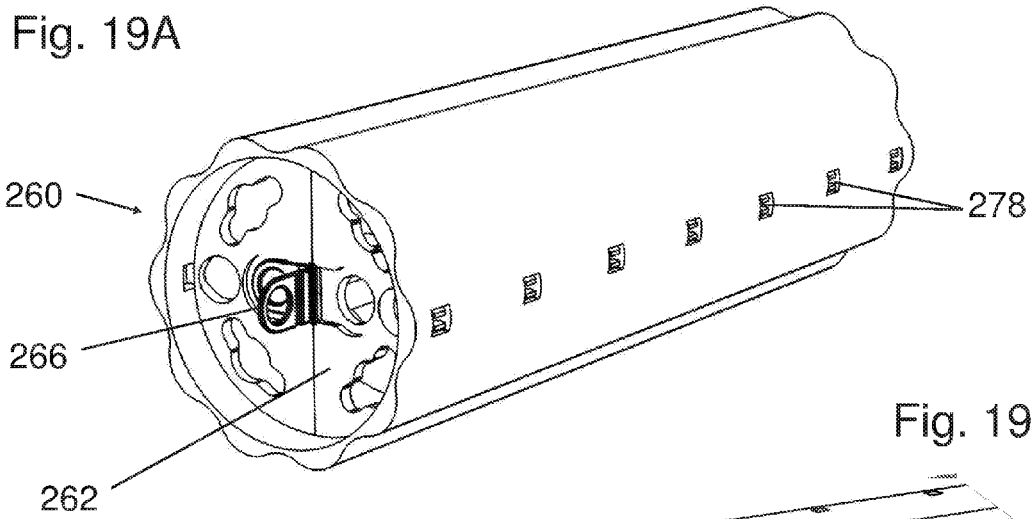
FIGS. 19A and 19B are perspective views of an alternative massage roller with an inner support structure comprised of discs that fold in half.
Figure 19B:
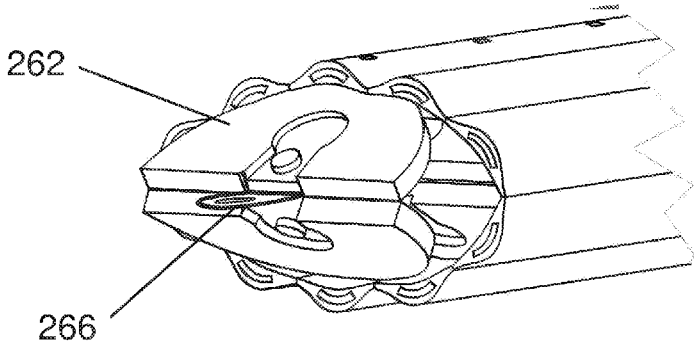
Figure 19C:
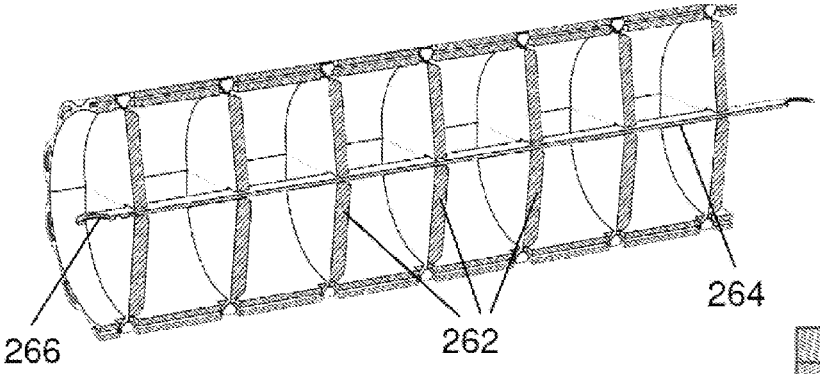
FIGS. 19C and 19D show cutaway views of the open and collapsed inner folding disc support structure.
Figure 19D:
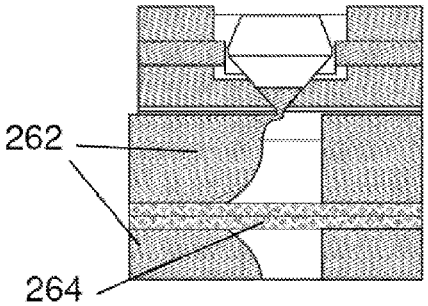
Figure 19E:
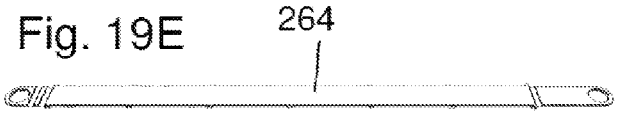
FIG. 19E shows a connecting spar used to control the expanding or collapsing of multiple discs at once.

FIGS. 19A-19E show yet another configuration for a massage roller 260 that has a different inner support disc structure in which the discs 262 are designed to fold in half, as shown in the partially collapsed position of FIG. 19B. FIG. 19C shows a cutaway view that reveals a multitude of inner support discs 262 that are formed to fold in half as described below. The discs 262 are linked to each other via a thin, wide common connecting spar 264. FIG. 19E shows an unattached connecting spar 264 with an ergonomic pull located on either end. The connecting spar 264 allows the user to control all the discs simultaneously when he or she wishes to expand or collapse the inner support structure. By pulling on one end 266 of the connecting spar 264 the user can collapse all the discs at once (as shown in process in FIG. 19B). Conversely, by pulling on the opposite end, the user can expand all the discs at once. FIG. 19D shows a cutaway view of a fully collapsed inner support structure in which the discs 262 are completely folded in half and the thin connecting spar 264 is sandwiched in between the discs. It should be noted that though the attached figures and description describe one connecting spar with a common folding direction, an alternative is considered whereby the support structure is formed with two sets of inwardly folding support discs with each set linked via its own connecting spar. Thereby, similar to the exemplary support structure shown in FIG. 5A, the user would pull on the opposite connecting spars to expand the inner support structure, and conversely push on the outermost discs to collapse the entire structure. Furthermore, the solid connecting spar 264 could be replaced with one or more flexible cords or other such members that a user pulls on to convert the discs 262 from their folded to unfolded states, or vice versa.

Figure 20A:
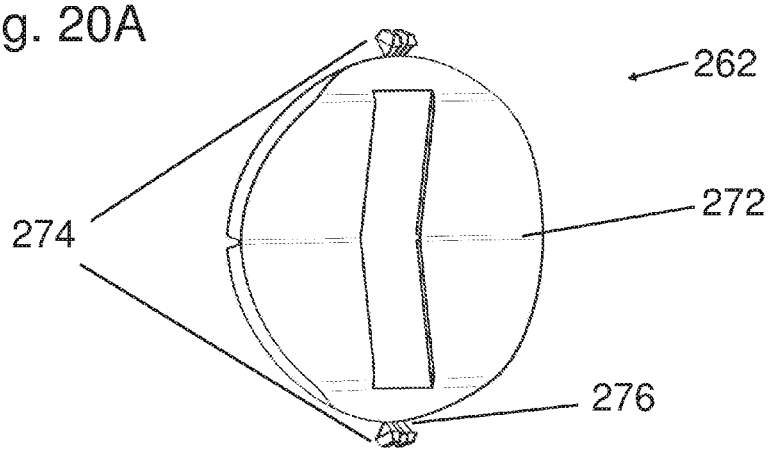
FIGS. 20A, 20C-E show perspective views of a folding inner support disc.
Figure 20B:
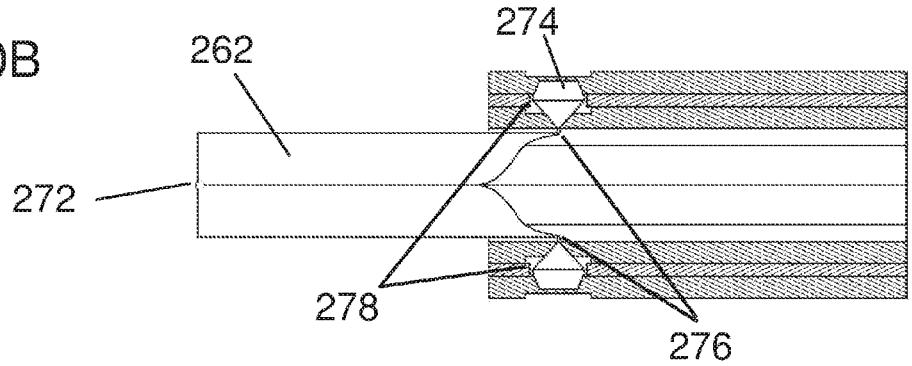
FIG. 20B shows a cutaway view of a collapsed folding support disc attached to the outer contact skin.
Figure 20C:
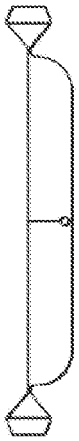
Figure 20D:
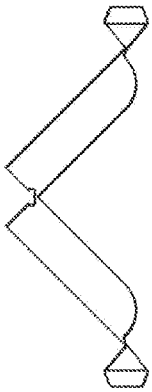
Figure 20E:
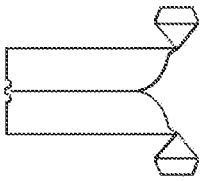
Figure 21A:
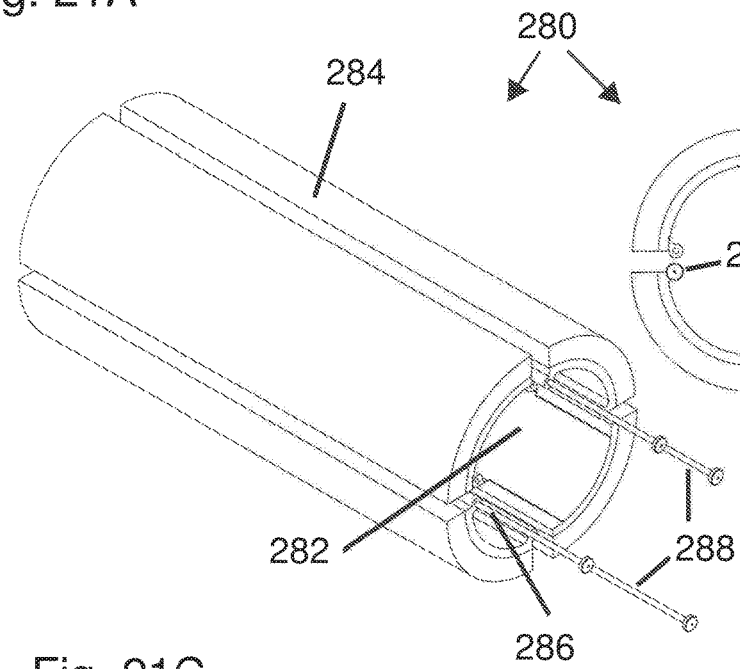
FIGS. 21A-21D are perspective assembled and exploded views of a still further collapsible massage roller structure.
Figure 21B:
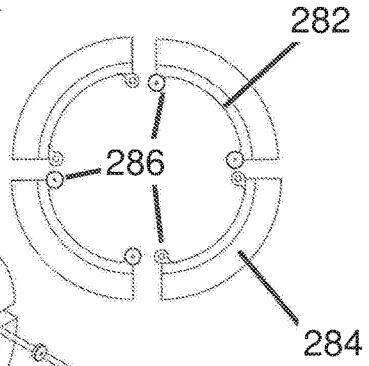
Figure 21C:
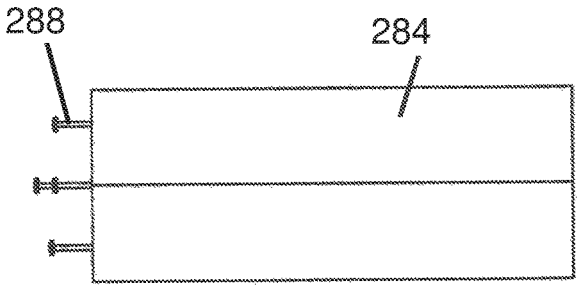
Figure 21D:
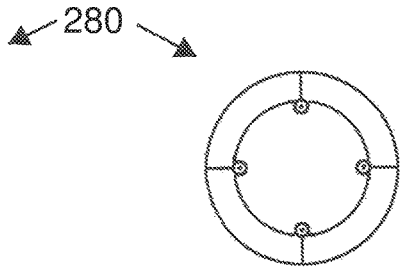

FIGS. 20A-20E show more detail of the folding support disc structure described in the paragraph above. FIG. 20A shows a perspective view of a singular support disc 262 that is formed to fold along a hinged seam 272 across the diameter of the disc. The disc 262 has two hinged 276 attachment points 274 on opposite sides that are designed to connect directly to the outer skin of the massage roller. In the illustrated embodiment, the attachment points 274 comprise pentagon-shaped molded members connected to the body of the discs 262 via a living hinge 276. The living hinge 276 allows the disc to fold relative to the outer contact skin. FIG. 20B shows the discs attached to the contact skin via the snap-fit tongues 274 on the support disc 262 that are inserted into opposed grooves 278 on the contact skin (also seen in FIG. 19A). However, the attachment points could also be simple hinges attached to the outer skin via various means. The disc 262 thereby has three separate hinges that have an accordion like collapsing effect when the support structure is flattened. FIGS. 20C-20E show the progression of a singular disc being collapsed from the fully open (FIG. 20C) to the fully collapsed position (FIG. 20E). The discs are then connected to each other by a connecting spar 264 so that all the discs behave in the same manner when the user expands or collapses the structure. Alternatively, depending on the configuration, the folding discs 262 could be attached so that they all fold inward. For example, in a four disc configuration, the discs 262 could be connected and controlled by two separate connecting spars 264, so that all four folding discs are collapsed inwards, two by two.

Finally, FIGS. 21A-21D show a still further collapsible massage roller 280 which instead of being collapsed flat is disassembled. The massage roller 280 comprises four internal stiffening sections 282 that extend the length of the roller and are formed in quarter circles in radial cross-section. A compressible contact skin is formed by adhering foam pieces 284 on the outside of the stiffening sections 282. As seen in the disassembled view of FIG. 21B, each of the stiffening sections 282 features a series of small tubes 286 fastened to their inner walls. The tubes 286 are offset with respect to the tubes on the adjacent sections 282 so as to fit together much like a typical door hinge. Stiff elongated rods 288 can be threaded through the aligned tubes 286 at the junction of adjacent stiffening sections 282 to hold the four sections together. In this way, the tubular roller 280 can be disassembled by removing the elongated rods from within the tubes 286 so that the four stiffening sections 282 can be separated. By virtue of their arcuate shape, the four pieces can be stacked together and the elongated rods 288 can be placed back within some of the tubes 286 so that the entire assembly can remain together.

While the invention has been described in its preferred embodiments, it is to be understood that the words which have been used are words of description and not of limitation. Therefore, changes may be made within the appended claims without departing from the true scope of the invention.

What is claimed is:

1. A portable fitness roller comprising:

an outer contact skin having an outer compressible surface configured for use as a fitness roller, wherein the outer contact skin includes a series of rigid axial stiffeners running parallel to a central roller axis and extending a length of the outer contact skin, adjacent axial stiffeners being joined together via joints parallel to the central roller axis so that the axial stiffeners and outer contact skin can be formed into a tubular expanded shape defining a cylindrical volume and the axial stiffeners may be released from the tubular expanded shape so as to convert to a collapsed shape, the fitness roller in the expanded shape having sufficient strength to support the weight of a person rolling thereon without collapse; and a plurality of stiffening elements disposed within the outer contact skin so as to contact and radially support the outer contact skin in the tubular expanded shape and that are movable relative to each other to permit the outer contact skin to assume the collapsed shape by manually displacing two of the plurality of stiffening elements located at each longitudinal end of the support structure.

2. The fitness roller of claim 1, wherein the axial stiffeners can pivot with respect to each other to convert the axial stiffeners from the tubular expanded shape to the collapsed shape.

3. The fitness roller of claim 2, wherein the joints are flexible and formed by longitudinally-extending living hinges in a foam connecting sheet joining the axial stiffeners.

4. The fitness roller of claim 1, wherein the outer compressible surface comprises a series of uniformly-spaced foam bumps.

5. The fitness roller of claim 1, wherein the outer compressible surface is formed by foam pieces adhered on the outside of the axial stiffeners.

6. The fitness roller of claim 1, wherein the stiffening elements are movable to convert the outer contact skin from the collapsed shape to the tubular expanded shape by manually pulling the two stiffening elements located at each longitudinal end of the support structure.

7. A portable fitness roller, comprising:

an outer contact skin having an outer compressible surface suitable for use as a fitness roller, the outer contact skin adapted to convert between a tubular first configuration defining a cylindrical volume and a longitudinal axis and a second configuration in which the cylindrical volume is substantially reduced; and a support structure located within the outer contact skin that radially supports the outer contact skin in the tubular first configuration and the fitness roller in the first configuration having sufficient strength to support the weight of a person rolling thereon without collapse, the support structure adapted to convert the outer contact skin between the first and second configurations, the support structure comprised of a plurality of stiffening elements disposed within the outer contact skin that radially support the outer contact skin in the first configuration and that are movable relative to each other to permit the outer contact skin to assume the second configuration, the stiffening elements being movable by manually pushing two of the plurality of stiffening elements located at each longitudinal end of the support structure toward each other.

8. The fitness roller of claim 7, wherein the stiffening elements comprises axial stiffeners running parallel to the longitudinal axis and extending a length of the outer contact skin, and wherein adjacent axial stiffeners are joined together via joints parallel to the longitudinal axis such that the axial stiffeners can pivot with respect to each other, and wherein the joints are flexible and formed by longitudinally-extending living hinges in a foam connecting sheet joining the axial stiffeners.

9. The fitness roller of claim 8, wherein the outer surface is formed by foam pieces adhered on the outside of the axial stiffeners.

10. The fitness roller of claim 7, wherein the support structure further includes axial stiffeners running parallel to the longitudinal axis and extending a length of the outer contact skin, wherein the stiffening elements comprise a plurality of rigid elements disposed within the cylindrical volume, the rigid elements being sized to contact and radially support the axial stiffeners when the contact skin is in the first configuration, the rigid elements being movable between a first orientation radially supporting the axial stiffeners and a second orientation that permits the axial stiffeners to collapse together so that the second configuration of the contact skin is substantially flat.

11. The fitness roller of claim 10, wherein the rigid elements comprise rigid discs extending generally perpendicular to the longitudinal axis in their first orientations.

12. The fitness roller of claim 7, wherein the stiffening elements comprise flat disks.

13. The fitness roller of claim 12, wherein the stiffening elements are movable to convert the outer contact skin from the second configuration to the first configuration by manually pulling on cords that extend through the two stiffening elements located at each longitudinal end of the support structure.

14. A portable fitness roller, comprising:

an outer contact skin having an outer compressible surface configured for use as a fitness roller in a tubular expanded first configuration that defines a cylindrical volume and a central roller axis; and a support structure located within the outer contact skin that radially supports the outer contact skin in the first configuration and the fitness roller having sufficient strength to support the weight of a person rolling thereon without collapse, the support structure adapted to convert the outer contact skin between the first configuration and a second collapsed configuration wherein the cylindrical volume is substantially reduced, the support structure comprised of a plurality of stiffening elements disposed within the outer contact skin so as to contact and radially support the outer contact skin in the first configuration and that are movable relative to each other to permit the outer contact skin to assume the second collapsed configuration, wherein the stiffening elements are movable to convert the outer contact skin from the second configuration to the first configuration by manually pulling two of the plurality of stiffening elements located at each longitudinal end of the support structure.

15. The fitness roller of claim 14, wherein the support structure further includes axial stiffeners running parallel to the central roller axis and extending a length of the outer contact skin, wherein the stiffening elements comprise a plurality of rigid elements disposed within the cylindrical volume, the rigid elements being sized to contact and radially support the axial stiffeners when the outer contact skin is in the first configuration, the rigid elements being movable between a first orientation radially supporting the axial stiffeners and a second orientation that permits the outer contact skin to convert to the second configuration.

16. The fitness roller of claim 14, wherein the stiffening elements comprise rigid discs extending generally perpendicular to the central roller axis.

17. The fitness roller of claim 14, wherein the stiffening elements move to permit the outer contact skin to convert to the second configuration by manually pushing two stiffening elements located at each longitudinal end of the support structure toward each other.

18. The fitness roller of claim 14, wherein the stiffening elements each comprises a disc having cutouts formed by an outer ring and a stiffening spar that extends through a center of the disc which can be manually pulled.

* * * * *